US009925658B2

(12) United States Patent
Schein et al.

(10) Patent No.: US 9,925,658 B2
(45) Date of Patent: Mar. 27, 2018

(54) MAGNET SANDWICHING STORAGE TRAY

(71) Applicant: All About Packaging Inc., Appleton, WI (US)

(72) Inventors: Thomas P. Schein, Appleton, WI (US); Brent J. Grinwald, Appleton, WI (US)

(73) Assignee: All About Packaging, Inc., Appleton, WI (US)

( * ) Notice: Subject to any disclaimer, the term of this patent is extended or adjusted under 35 U.S.C. 154(b) by 161 days.

(21) Appl. No.: 14/930,930

(22) Filed: Nov. 3, 2015

(65) Prior Publication Data

US 2016/0121478 A1 May 5, 2016

Related U.S. Application Data

(60) Provisional application No. 62/074,115, filed on Nov. 3, 2014.

(51) Int. Cl.
*B25H 3/06* (2006.01)
*B65D 65/38* (2006.01)

(52) U.S. Cl.
CPC ..... *B25H 3/06* (2013.01); *B65D 65/38* (2013.01); *B65D 2313/04* (2013.01)

(58) Field of Classification Search
CPC ..... B25H 3/06; B65D 2313/04; B65D 65/38; B65D 21/02; B65D 21/0201; B65D 21/022; B65D 21/0209; B65D 25/10; A61C 3/04

(Continued)

(56) References Cited

U.S. PATENT DOCUMENTS 3,546,643 A * 12/1970 Virostek ..... H01F 7/0215 335/303
5,976,653 A * 11/1999 Collette ..... B29C 49/0005 264/512

(Continued)

OTHER PUBLICATIONS

E-Z Red Company, E-Z Red Company WR1500 15 Piece Magnetic Wrench Holder, Amazon product for sale, https://www.amazon.com./Torin-MPH10RT-Magnetic-Plier-Holder/dp/B00T2U112A, printed Feb. 1, 2017, 7 pages.

(Continued)

*Primary Examiner* — King M Chu
*Assistant Examiner* — James M Van Buskirk
(74) *Attorney, Agent, or Firm* — Thomas J. Connelly; Northwind IP Law, S.C.

(57) ABSTRACT

A magnet sandwiching storage tray for retaining a plurality of articles, especially tools formed from a ferrous metal. The magnet sandwiching storage tray has a top tray member, a bottom tray member, and a plurality of magnets positioned therebetween. The top and bottom tray members each have a plurality of channels formed therein. Each of the plurality of channels, formed in the top tray member, is sized to temporarily retaining an article, such as a wrench, a socket, or some other tool. The plurality of magnets is positioned within the channels of the bottom tray member and is retained therein by the interior of the top tray member. The magnets exert a sufficient force through the top tray member to attract and temporarily retain the articles in the channels formed in the top tray member. The bottom tray member is secured to the underside of the top tray member so that the plurality of magnets is retained therebetween.

20 Claims, 24 Drawing Sheets

(58) Field of Classification Search
USPC ..... 206/350
See application file for complete search history.

(56) References Cited

U.S. PATENT DOCUMENTS

| | | | | |
|---|---|---|---|---|
| 8,256,618 | B2 * | 9/2012 | Schein | B25H 3/06 206/372 |
| 8,727,142 | B2 | 5/2014 | Shapiro | |
| 2015/0018113 | A1 | 1/2015 | Tan | |
| 2015/0196370 | A1 * | 7/2015 | Wong | A61C 3/04 206/350 |

OTHER PUBLICATIONS

Torin, Torin-MPH10RT Magnetic Plier Holder, Amazon product for sale, https://www.amazon.com/Z-Red-Company-WR1500-Magnetic/dp/B000OCHBCE, printed Feb. 1, 2017, 7 pages.
Torin, Torin SDHI5RT Magnetic Screwdriver Holder, Amazon product for sale, https://www.amazon.com/Torin-SDH15RT-Magnetic-Screwdriver-Holder/dp/B00DS3GK0A, printed Feb. 1, 2017, 7 pages.
DODO729 et al., Thread: Magnetic Wrench Holder, discussion thread, http://www.instructables.com/id/MAGNETIC-WRENCH-HOLDER/, printed Feb. 1, 2017, 6 pages.

* cited by examiner

MAGNET SANDWICHING STORAGE TRAY

CROSS REFERENCE TO RELATED APPLICATIONS

This application claims priority as a non-provisional application to U.S. Ser. No. 62/074,115, filed Nov. 3, 2014.

FIELD OF THE INVENTION

This invention relates to a magnet sandwiching storage tray.

BACKGROUND OF THE INVENTION

Storage trays are used to temporarily retain one or more articles as a unit or set. Storage trays provide a convenience way to market various size articles, especially tools, such as wrenches, sockets, drills, screw drivers, bits, etc. which are normally sold as a set and which contain a plurality of different size items. The storage tray also serves as a good way to keep the various articles or tools together after they are purchased, so that the owner can easily pick out the particular size tool needed for a particular job. Many tools are constructed from a ferrous metal. By "ferrous" it is meant of, relating to or containing iron. A ferrous metal is attracted to a magnet. By a "magnet" It is meant an object that is surrounded by a magnet field and has the property, either natural or induced, of attracting iron or steel. By incorporating one or more magnets into a storage tray, articles made of iron or steel can be temporarily held in a predetermined position until needed.

Now a magnet sandwiching storage tray has been invented which can retain a plurality of articles formed from iron or steel in a predetermined arrangement until needed.

SUMMARY OF THE INVENTION

Briefly, this invention relates to a magnet sandwiching storage tray for temporarily retaining a plurality of articles. The articles can vary in size from one another. The articles can vary but usually include tools, such as wrenches, sockets, drills, screw drivers, bits, etc. Each of the articles or tools has a portion, section, shaft, etc. that has a magnet affinity. The magnet sandwiching storage tray has a 3-dimensional configuration. The magnet sandwiching storage tray includes a top tray member having a plurality of channels each sized and shaped to receive an article. The magnet sandwiching storage tray can hold three or more articles. Each of the plurality of channels has an open first end, an oppositely aligned open second end, a front wall, a rear wall and a floor. The rear wall of each of the channels is angled upward and terminates at a spacer wall. This angled structure facilitates insertion and removal of the articles from each of the channels. The spacer walls separate adjacent channels. The top tray member also has a bottom with an open interior cavity formed therein.

The magnet sandwiching storage tray also includes a bottom tray member having a plurality of channels, each sized and shaped to receive a magnet. Each of the plurality of channels, formed in the bottom tray member, corresponds with one of the plurality of channels formed in the top tray member. A portion of the bottom tray member is sized and configured to nest in the open interior cavity of the top tray member. By so doing, the top and bottom tray members form a plurality of nesting channels. The bottom tray member is also secured to the top tray member about its perimeter.

The magnet sandwiching storage tray further includes a plurality of magnets. Each of the magnets is retained within one of the plurality of nesting channels. Each of the magnets has a front face underlying the rear wall of each of the channels formed in the top tray member so as to magnetically attract and retain one of the articles against the rear wall of each of the plurality of channels formed in the top tray member.

The general object of this invention is to provide a magnet sandwiching storage tray which can temporary retain a plurality of articles. A more specific object of this invention is to provide a magnet sandwiching storage tray which can temporarily retain a plurality of tools, such as wrenches, sockets, drills, screw drivers, bits, etc.

Another object of this invention is to provide a magnet sandwiching storage tray having a 3-dimensional configuration and which is formed from a top tray and a bottom tray which cooperate to sandwich a plurality of magnets therebetween.

A further object of this invention is to provide a magnet sandwiching storage tray that can be formed from a polymer film, such as polypropylene or polyethylene. Still another object of this invention is to provide a magnet sandwiching storage tray which is economical to manufacture.

Still further, an object of this invention to provide a magnet sandwiching storage tray which can temporarily retain three or more articles.

Other objects and advantages of the present invention will become more apparent to those skilled in the art in view of the following description and the accompanying drawings.

DETAILED DESCRIPTION OF THE INVENTION

Referring to FIGS. 1-4, a magnet sandwiching storage tray 20 is illustrated for storing articles 22 of various shapes and sizes. The magnet sandwiching storage tray 20 has a 3-dimensional configuration. Each article 22 can include a portion having a magnet affinity. By "magnetic affinity' it is meant having an attraction to a magnet or a magnetic force. By a "magnet" it is meant an object that is surrounded by a magnet field and has the property, either natural or induced, of attracting iron or steel. The magnet sandwiching storage tray 20 retains such articles 22 in place and reduces the likelihood that such articles 22 will shift or become separated or removed from the magnet sandwiching storage tray 20. The magnet sandwiching storage tray 20 can temporarily retain such articles 22 until they need to be removed.

Figure 1:
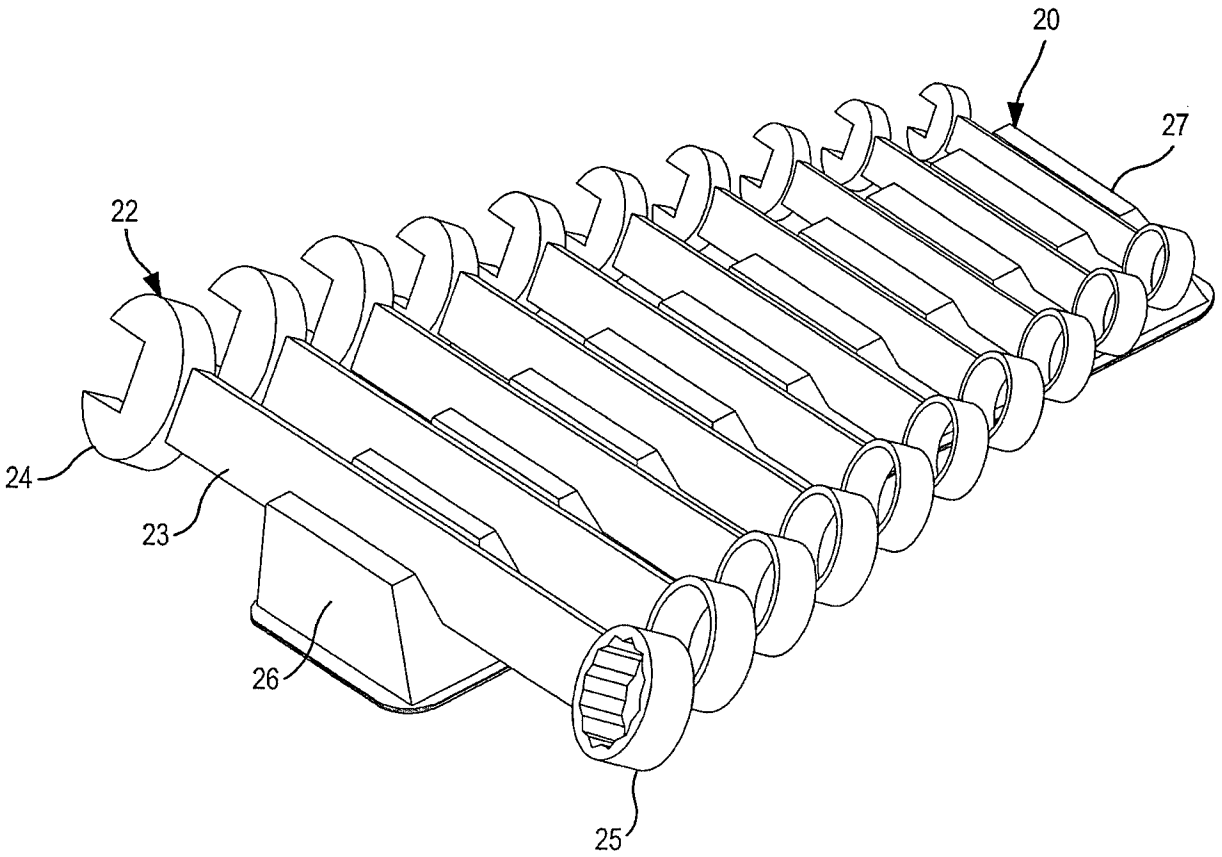
FIG. 1 is a perspective view of a magnet sandwiching storage tray temporarily retaining a plurality of articles, in the form of wrenches.
Figure 2:
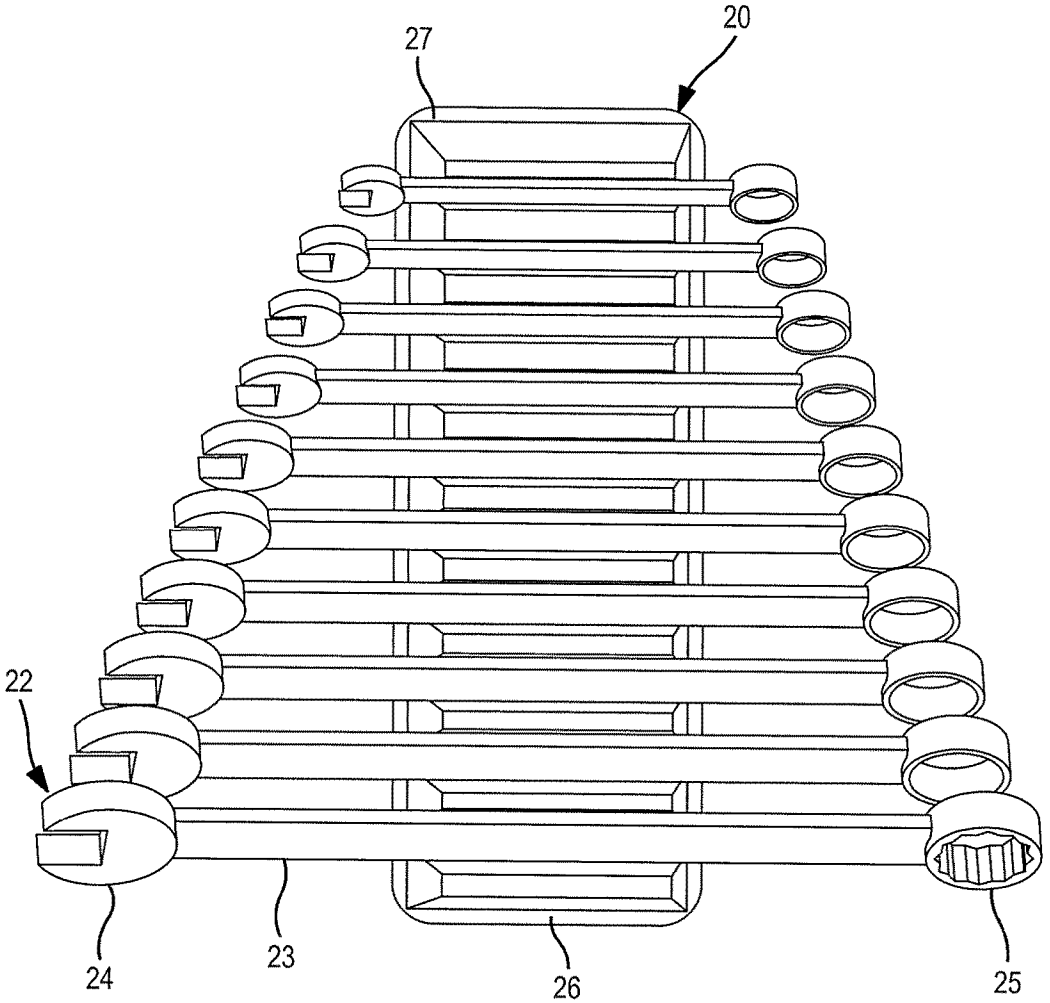
FIG. 2 is a top view of the magnet sandwiching storage tray and articles shown in FIG. 1.
Figure 3:
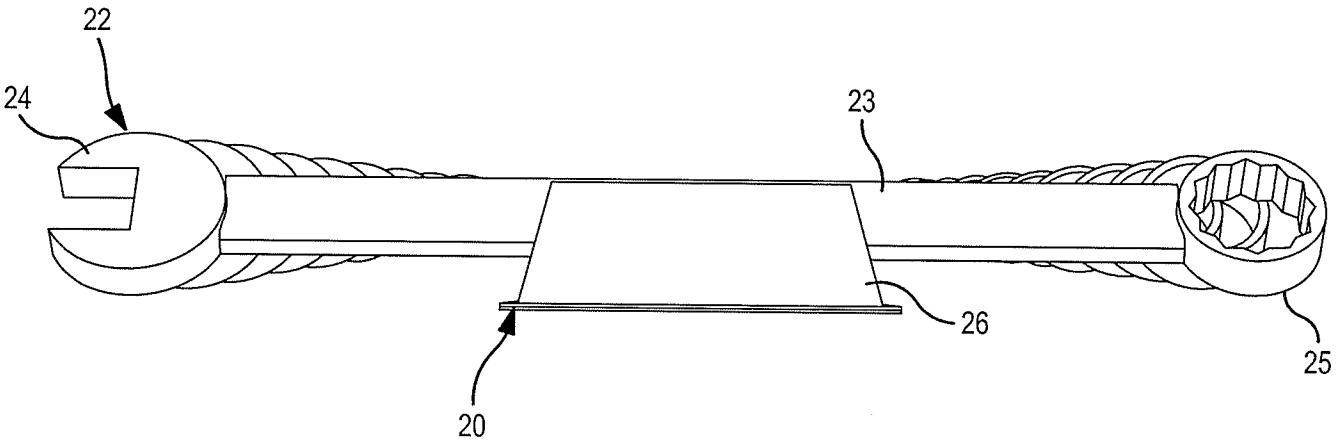
FIG. 3 is a front end view of the magnet sandwiching storage tray and articles shown in FIG. 1.
Figure 4:
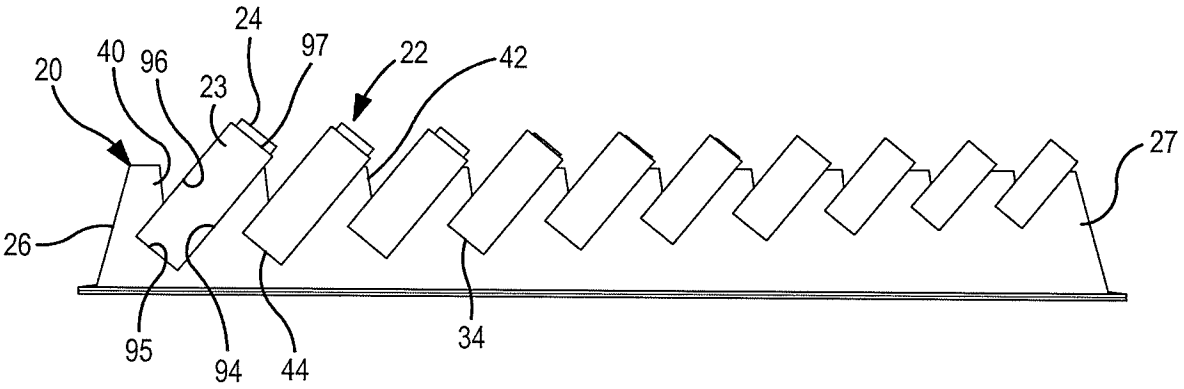
FIG. 4 is a side view of an alternative magnet sandwiching storage tray temporarily retaining a plurality of sockets.

As shown in FIGS. 1-4, the magnet sandwiching storage tray 20 magnetically retains in place one or more articles 22. The magnet sandwiching storage tray 20 is especially useful in retaining a series of articles 22, each of a different size. The articles 22 can vary. The articles 22 can be wrenches, sockets, drills, screw drivers, bits, etc. In FIGS. 1-3, the articles 22 are depicted as wrenches. In FIG. 4, the articles 22 are depicted as sockets. By "wrench" it is meant any of various hand or power tools with fixed or adjustable jaws for gripping, turning or twisting objects such as nuts, bolts or pipes. By "socket" it is meant an opening or a cavity into which an inserted part is designed to fit. Sockets are interchangeable on a socket wrench.

Referring again to FIGS. 1-3, each wrench has a similar configuration but is of a different size. Each wrench has a shaft 23 and a head 24 formed on a first end and a head 25 formed on an oppositely aligned second end. Each shaft has a length that is greater than about 3 inches. The shaft 23 carries or is formed from a material having a magnet affinity, such as a ferrous material. Iron and steel are materials from which the articles 22 can be formed. Alternatively, only a portion of the article 22 has to be formed or include a ferrous material.

In one implementation, an attachment having a magnet affinity is affixed to each shaft 23. In another implementation, an insert having a magnet affinity is inserted into or molded within each shaft 23. In still another implementation, the shaft 23 is formed from a material having a magnet affinity. In still another implementation, the entirety of the article 22 is formed from at least one material having a magnet affinity.

Although the magnet sandwiching storage tray 20 is illustrated as retaining articles 22 of various sizes, with the larger articles 22 being located at a front 26 of the magnet sandwiching storage tray 20 and the smaller articles 22 being located or retained at a rear 27 of the magnet sandwiching storage tray 20, in other implementations, the storage tray 20 is alternatively configured such that the smaller articles 22 are retained at the front 26 of the magnet sandwiching storage tray 20 while the larger articles 22 are retained at the rear 27 of the magnet sandwiching storage tray 20. Although the magnet sandwiching storage tray 20 is illustrated as retaining wrenches, in other implementations, the magnet sandwiching storage tray 20 could magnetically retains other articles 22 or tools each having a single head 24 and a shaft 23 with at least a portion having a magnet affinity, such as a socket, as is shown in FIG. 4.

Figure 5:
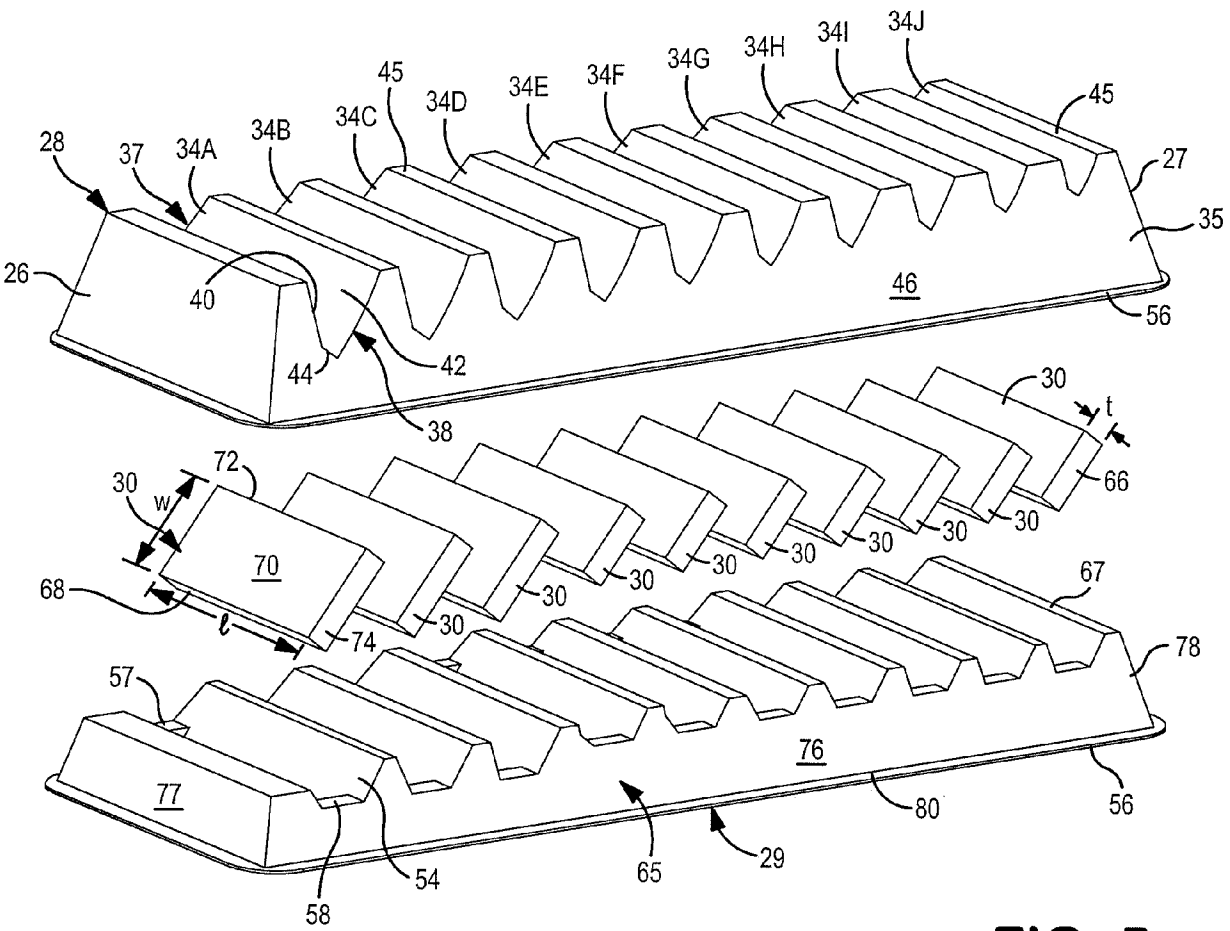
FIG. 5 is an exploded view of the magnet sandwiching storage tray shown in FIG. 1.
Figure 6:
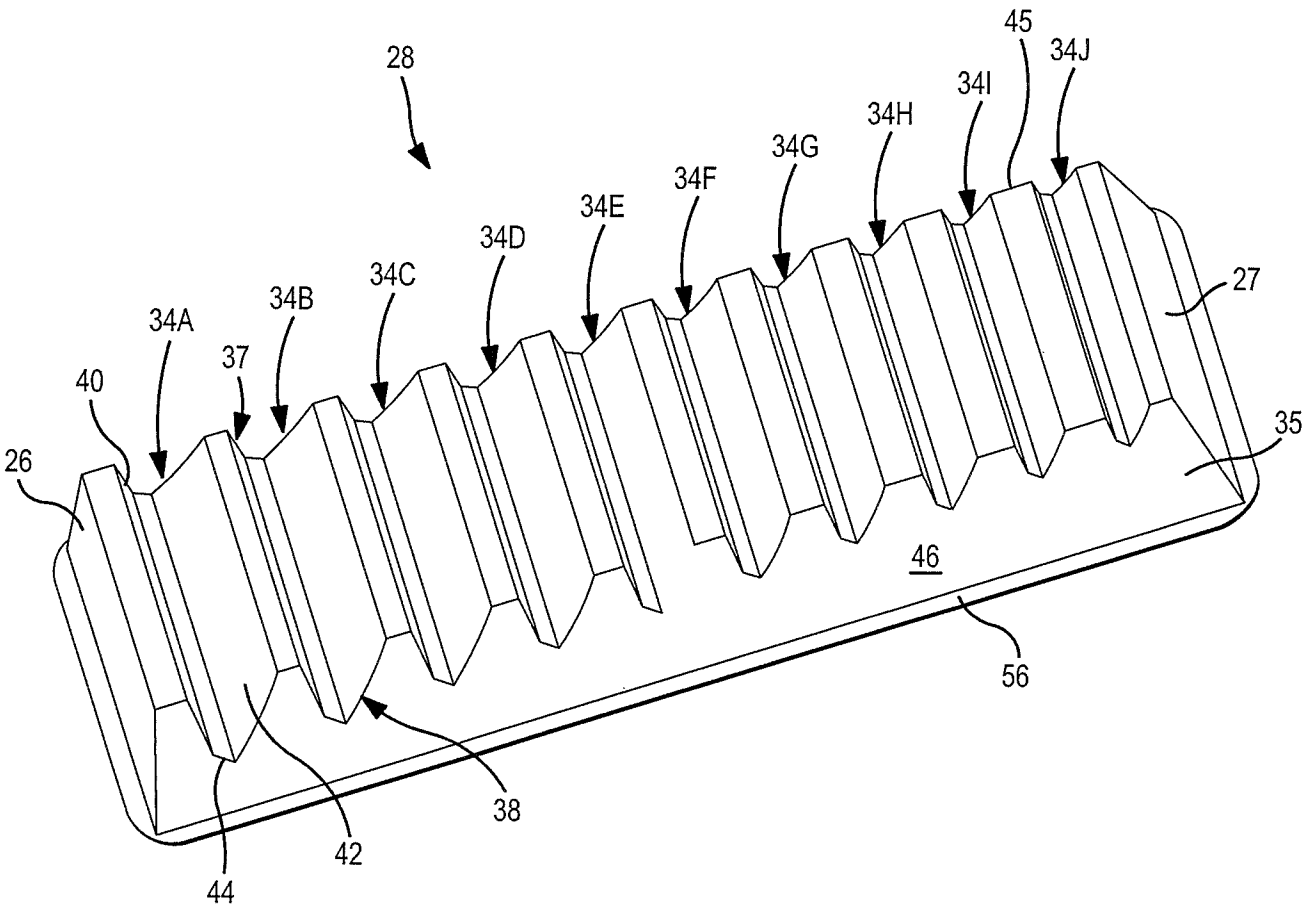
FIG. 6 is an isometric view of a top tray member of the magnet sandwiching storage tray shown in FIG. 1.
Figure 7:
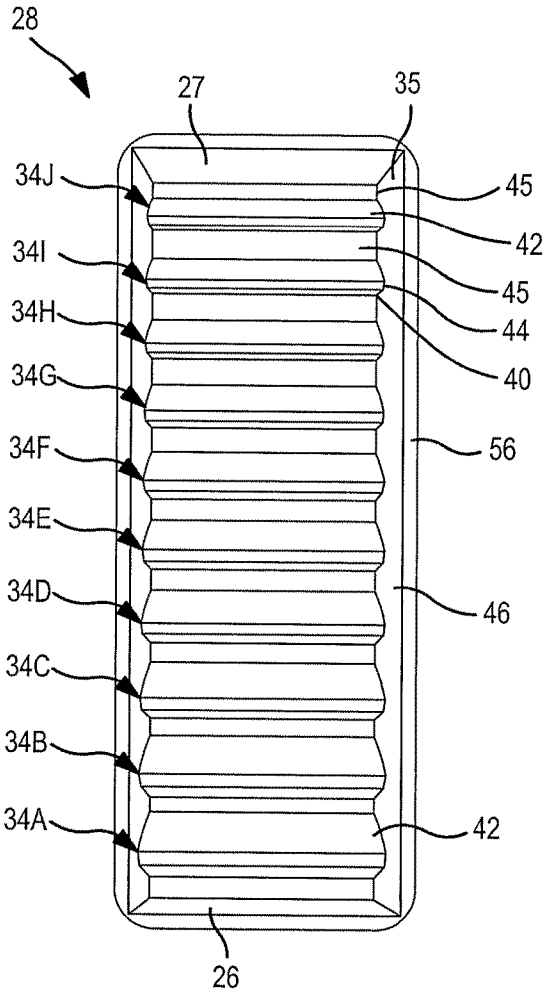
FIG. 7 is a top view of the top tray member of the magnet sandwiching store tray shown in FIG. 1.

Referring now to FIGS. 5-9, the magnet sandwiching storage tray 20 is shown with the articles 22 removed. As depicted in FIG. 5, the magnet sandwiching storage tray 20 includes a top tray member 28, a bottom tray member 29 and a plurality of magnets 30. The top tray member 28 has a 3-dimensional configuration. The bottom tray member 29 also has a 3-dimensional configuration. The top tray member 28 includes an upper surface containing a plurality of article receiving channels 34A, 34B, 34C, 34D, 34E, 34F, 34G, 34H, 34I and 34J (collectively referred to as channels 34), a perimeter wall 35, and an open interior cavity 36 (see FIG. 9). The channels 34 are aligned parallel to one another. Each of the channels 34 has a first open end 37 and a second opposite open end 38. Each of the channels 34 is shaped and sized to receive the shaft 23 of the article 22 to be retained therein.

It should be understood that the shaft 23 of each article 22 has a length that is greater than each of the plurality of channels 34 formed in the top tray member 28. This means that the heads 24 and 25 of each of the articles (wrenches) 22 projects or hangs out beyond the first and second open ends, 37 and 38 respectively. In instances where the article 22 has only one head 24, the one head 24 can extend beyond either the first open end 37 or the second open end 38 of the channel 34.

The magnet sandwiching storage tray 20, particularly the top tray member 28 and the bottom tray member 29 can be formed from various materials including but not limited to: plastics, thermoplastics, thermosetting plastics, styrene, foam, acrylic, nylon, paperboard, cardboard. The plastics include but are not limited to: polypropylene, polyethylene, or a combination thereof, thermoplastics, clear plastics, transparent plastics and colored plastics. The most likely thermoplastics that could be used would be polyvinyl chloride, polyethylene terephthalate or Acrylonitrile butadiene styrene (ABS). Other thermoplastics that could be used, other than those mentioned above, include polystyrene, polycarbonate or poly(methyl methacrylate)

Still referring to FIGS. 5-8, each of the channels 34 includes a front wall 40, a rear wall 42, and a floor 44. The front wall 40 extends vertically or upwardly from the floor 44. In one implementation, the front wall 40 extends parallel to a pure vertical direction or a vertical axis. In another implementation, the front wall 40 extends upwardly with a forward draft or angle of from between about 5% to about 10%, and nominally about 7%.

The floor 44 extends between the front wall 40 and the rear wall 42. In some implementations, the floor 44 is V-shaped, formed at the bottom intersecting portions of the front and rear walls, 40 and 42 respectively. As illustrated, the rear wall 42 is angled upward. The rear wall 42 can range from between about 10° to about 80° relative to a vertical axis. Desirably, the rear wall 42 is angled upward from the floor 44 by at least about 20°. More desirably, the rear wall 42 extends upward at an angle of from between about 30° to about 60°. Even more desirably, the rear wall 42 extends upward at an angle of from between about 35° to about 55°. In another example, the rear wall 42 extends upward at an angle of from between about 45°.

Still referring to FIG. 5, each of the top tray members 28 also includes a spacer wall 45 extending between the rear wall 42 and the front wall 40 of an adjacent channel 34. The rear wall 42 terminates at the spacer wall 45. The spacer wall 45 can vary in width. The spacer wall 45 is usually aligned parallel with a horizontal plane although it could be tilted forward or backward, if desired. The front most and rearward most channels, 34A and 34J respectively, are further spaced apart from the perimeter wall 35 by spacer walls 45, 45. In another implementation, the spacer walls 45 could be omitted, whereby the front and rear walls, 40 and 42 respectively, intersect and wherein the front and rear walls, 40 and 42 respectively, of the front most and the rearward most channels, 34A and 34J respectively, intersect with the perimeter wall 35.

Figure 8:
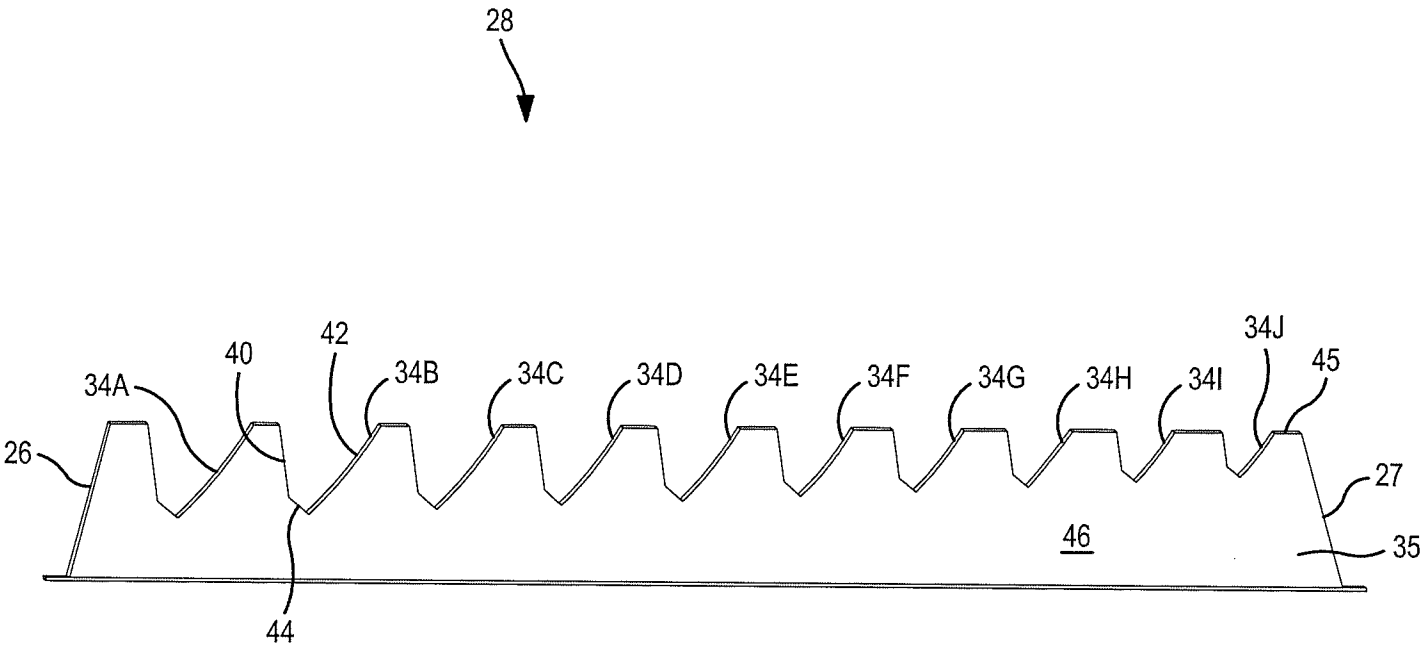
FIG. 8 is a side view of the top tray member of the magnet sandwiching storage tray shown in FIG. 1.

Still referring to FIGS. 4, 5 and 8, each of the plurality of channels 34 formed in the top tray member 28 has a depth. The depth of each channel 34 can vary. The depth of all the channels 34 can be the same. Alternatively, the depth of at least one of the channels 34 is greater than the depth of one of the remaining channels 34. In FIG. 5, the depths of the channels 34A, 34B, 34C, 34D, 34E and 34F are all the same and are greater than the depth of the channels 34G, 34H, 34I and 34J. It should be understood that all of the channels 34 could have a different depth or any combination of channels 34 could have an identical depth. In FIG. 8, the depth of the channels 34 incrementally decreases from the front 26 to the rear 27, decreasing from channel 34A to channel 34J. The decreased steps accommodate the different widths of the shafts 23 on the articles 22, extending from the lower edge 95 of each of shaft 23 to the upper edge 97 of each of the shafts 23, see FIG. 4. As a result, as is shown in FIG. 8, the channels 34 support each of the articles 22 such that an upper edge 97 of each of the shafts 23 is located in a single horizontal plane, level with one another, despite the different widths of the different size articles 22. In other implementations, the channels 34 may have similar depths.

Returning again to FIG. 4, when each of the channels 34 is receiving an article 22, the rear wall 42 supports a back face 94 of the shaft 23 of the article 22. The floor 44 supports a lower edge 95 of the shaft 23 of the article 22. The front wall 40 is shaped and sized so as to contact and/or abut against a front face 96 of the shaft 23 of the article 22. The front walls 40 of the plurality of channels 34 are aligned parallel to one another and each is aligned parallel to the spacer walls 45. In other implementations, the front wall 40 is alternatively spaced from the front face 96 of the shafts 23 of the article 22 when the associated channel 34 is receiving the article 22. In yet other implementations in which the floor 44 is omitted or includes a V-shaped intersection with the front and rear walls, 40 and 42 respectively, the front wall 40 will contact and engage the lower edge 95 of the shaft 23 of article 22.

Figure 9:
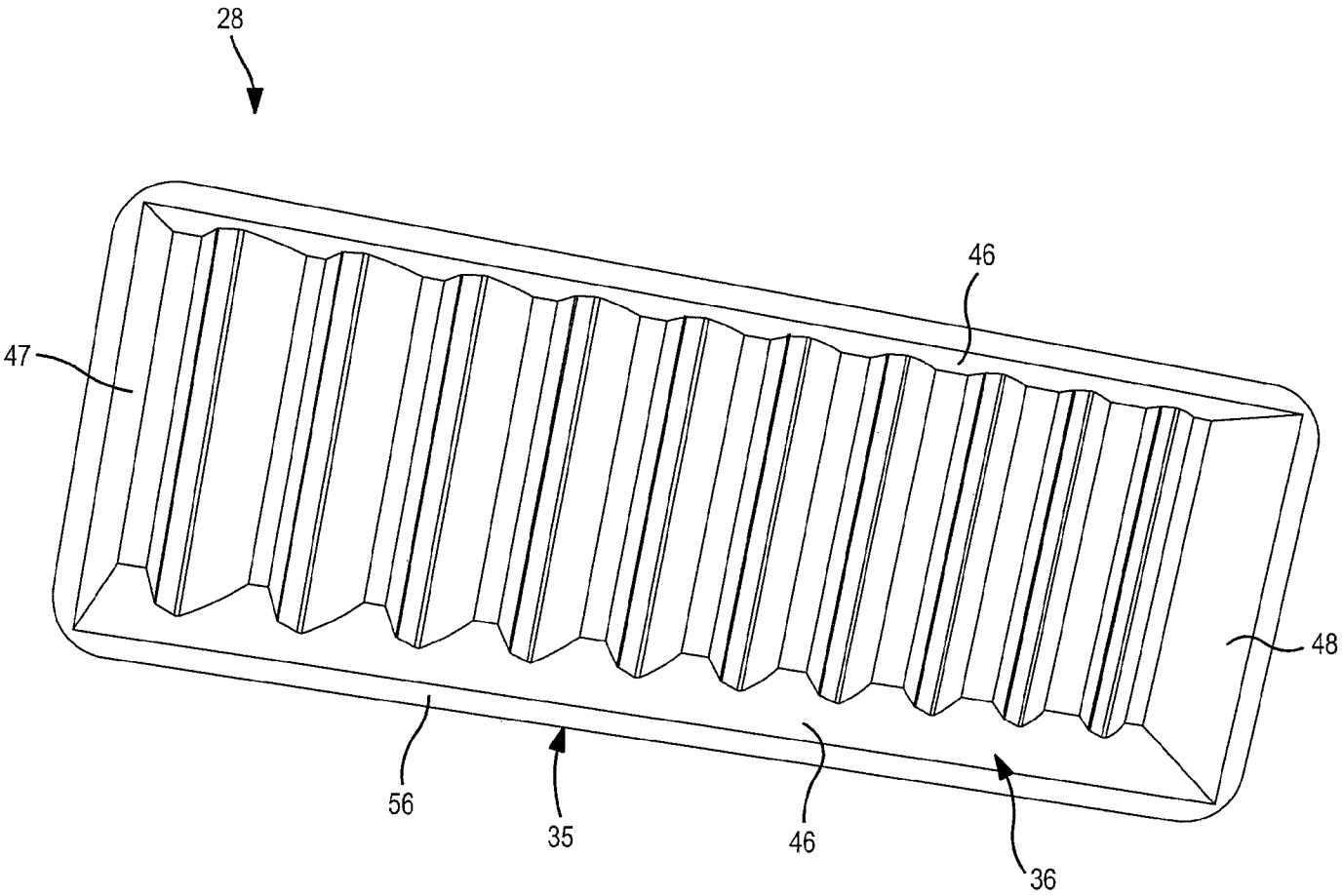
FIG. 9 is a bottom perspective view of the top tray member of the magnet sandwiching storage tray shown in FIG. 1.
Figure 10:
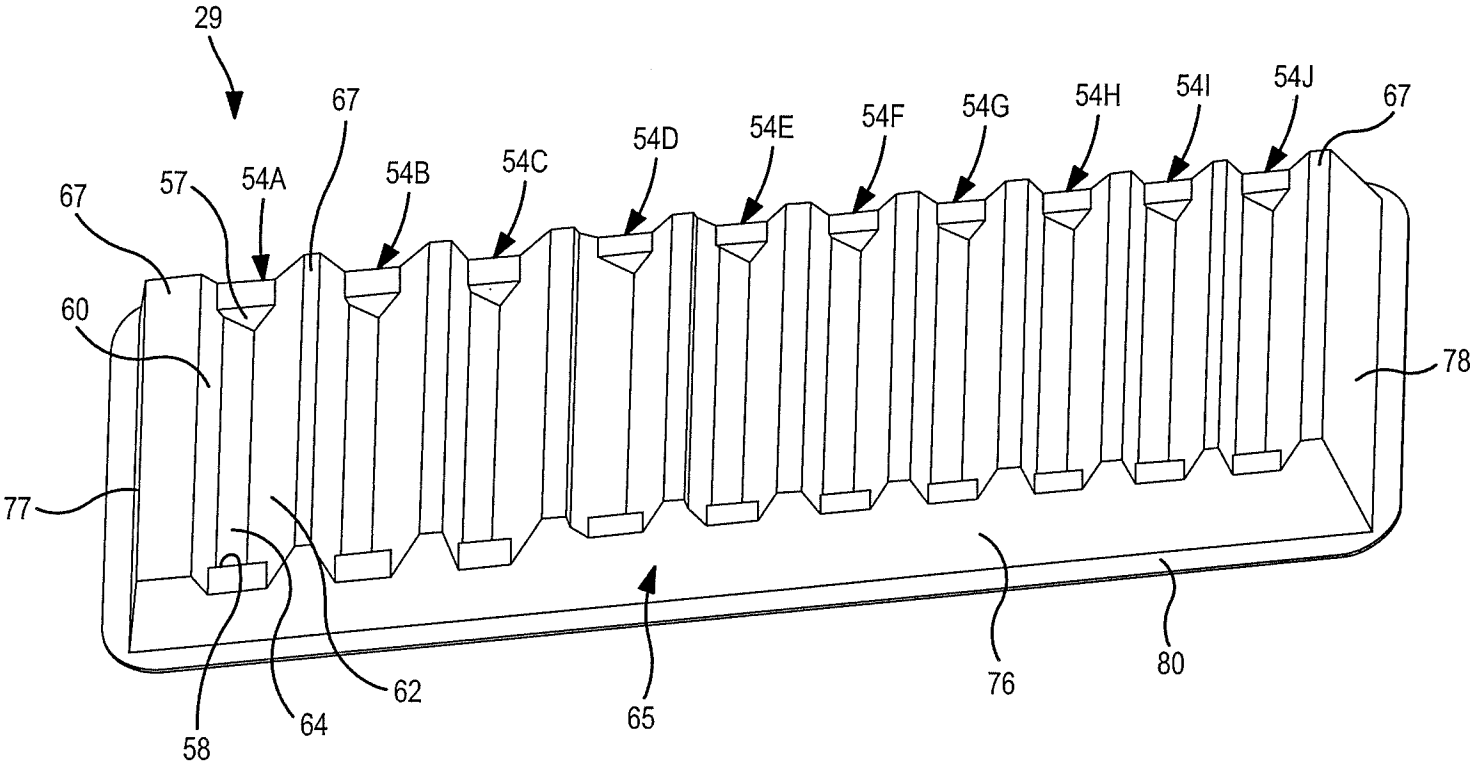
FIG. 10 is a top perspective view of a bottom tray member of the magnet sandwiching storage tray shown in FIG. 1.

Referring to FIGS. 9 and 10, the perimeter wall 35 extends about a perimeter of the top tray member 28 and extends between each of the channels 34, while forming a pair of sidewalls 46, 46, a front interior wall 47, a rear interior wall 48 and a rim 56. The perimeter wall 35, the front wall 40, the rear wall 42, the floor 44 and the top spacer wall 45 define an open interior cavity 36 formed in the bottom surface of the top tray member 28. The open interior cavity 36 is sized and configured to allow a portion of a bottom tray member 29 to engage and nest therein. The open interior cavity 36 is configured such that the rim 56 of the perimeter wall 35 contacts a corresponding rim 80, see FIG. 10, formed on the bottom tray member 29. The rims 56 and 80 facilitate attaching the top tray member 28 to the bottom tray member 29. The rims 56 and 80 can be secured together by using any means known to those skilled in the art. Such attachment means include but are not limited to: welding, fusing, bonding, adhering, using an adhesive, using glue, using a heat bond, using a pressure bond, using a heat and pressure bond, using an ultrasonic bond, etc. When the top and bottom tray members, 28 and 29 respectively, are secure together at the rims 56 and 80, the plurality of magnets 30 are captured therebetween and will be held stationary.

As illustrated, the top tray member 28 is integrally formed as a single unitary or homogenous body. In one implementation, the top tray member 28 is formed from a single molded film of material. The top tray member 28 can be formed from a polymer. The polymer can be polypropylene, polyethylene or a combination of two or more polymers. By "polymer" it is meant any of numerous natural or synthetic compounds of usually high molecular weight consisting of repeated linked units, each a relatively light and simple molecule. Any polymer known to those skilled in the art could be used to form the top tray member 28.

Still referring to FIGS. 5-9, the rear wall 42 of each of the channels 34 has a thickness. The thickness of the rear wall 42 can vary. The thickness of the rear wall 42 can be less than or equal to about 0.05 inches. Desirably, the thickness of the rear wall 42 is from between about 0.005 inches to about 0.05 inches. More desirably, the thickness of the rear wall 42 is from between about 0.01 inches to about 0.04 inches. Even more desirably, the thickness of the rear wall 42 is from between about 0.015 inches to about 0.03 inches. When the rear wall 42 has a thickness of less than about 0.05 inches, it facilitates enhanced magnet retention of the articles 22 within each of the channels 34 by the magnets 30 located directly beneath the top tray member 28. In implementations where the top tray member 28 is molded from a single layer, film or panel of material, the layer of material can have a thickness of less than about 0.05 inches, nominally between 0.005 inches and 0.025 inches. In other implementations, the thickness of the rear wall 42 or the entirety of the top tray member 28 may vary.

Figure 13:
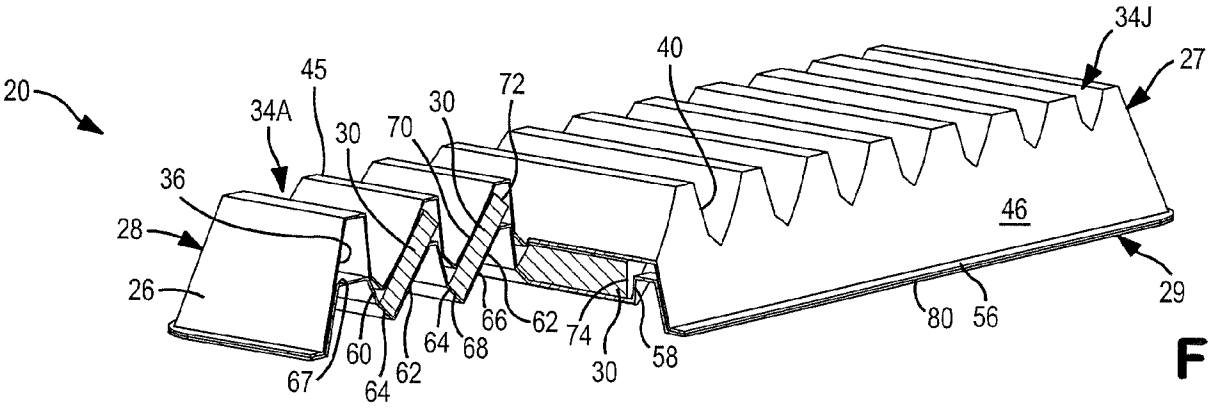
FIG. 13 is a perspective view of the bottom tray member nested with the top tray member and showing a partial cut-a-way revealing the magnets sandwiched therebetween.
Figure 12:
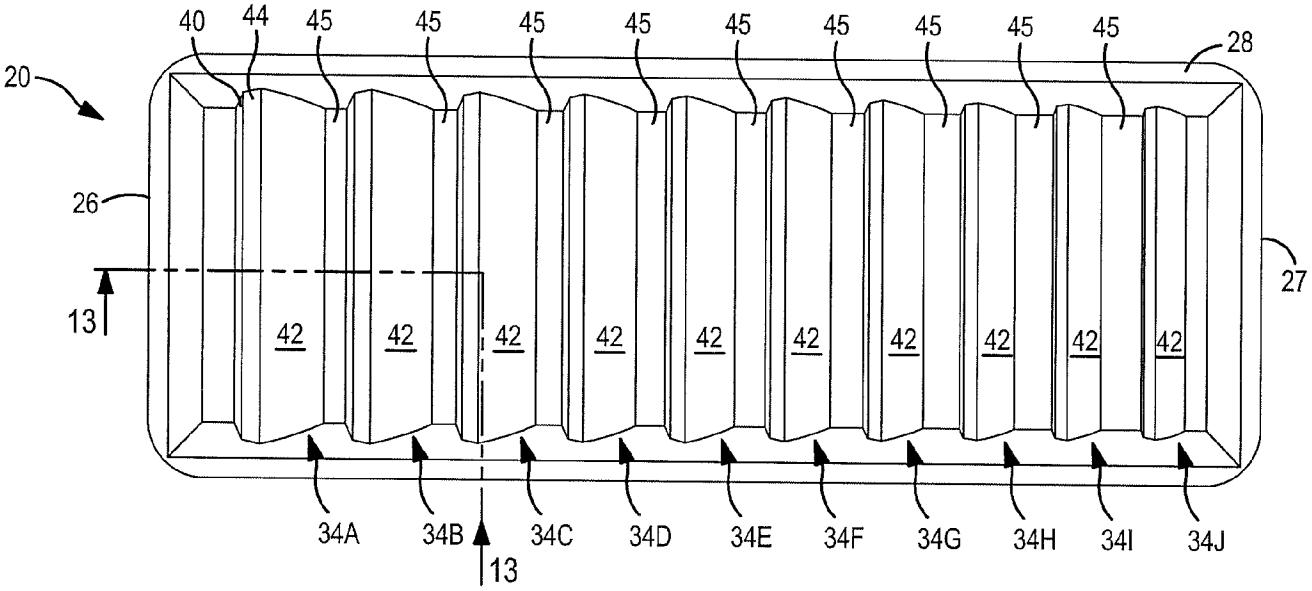
FIG. 12 is a top view of the magnet sandwiching storage tray shown in FIG. 1.
Figure 14:
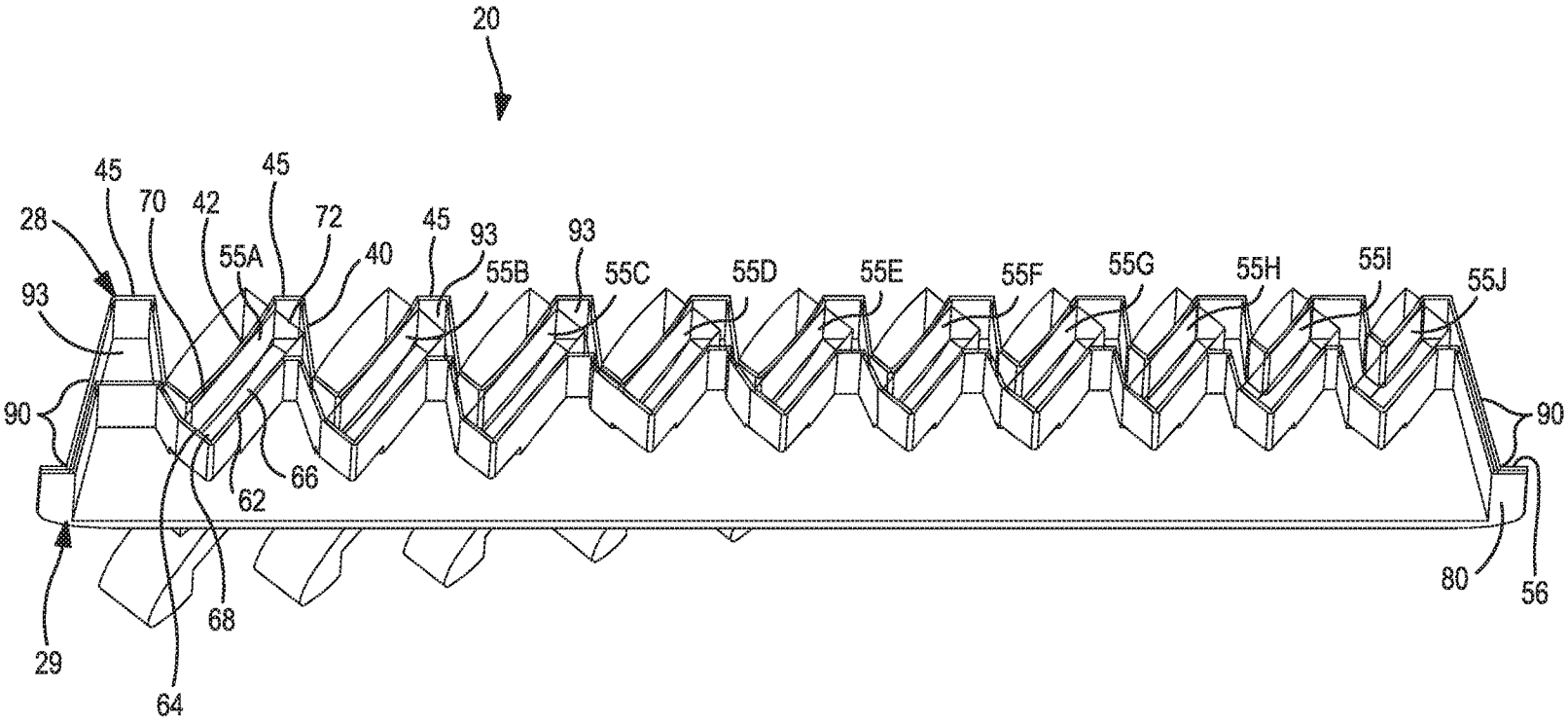
FIG. 14 is a cross-sectional view of the magnet sandwiching storage tray shown so in FIG. 13.

Referring now to FIGS. 10, 11, 13 and 14 the bottom tray member 29 is illustrated in greater detail. FIGS. 13 and 14 illustrate a portion of the bottom tray member 29 nested within the open interior cavity 36 of the top tray member 28 with the plurality of magnets 30 sandwiched therebetween. As shown in FIG. 10, the bottom tray member 29 includes a number of magnet receiving channels 54A, 54B, 54C, 54D, 54E, 54F, 54G, 54H and 54I (collectively referred to as channels 54) which correspond to the channels 34A, 34B, 34C, 34D, 34E, 34F, 34G, 34H, 34I and 34J, respectively, shown in FIG. 5. The channels 54 are aligned parallel to one another. The bottom tray member 29 also has a perimeter wall 65. Each of the channels 54 include a pair of oppositely aligned sidewalls 57 and 58, a front wall 60 (see FIG. 10), a rear wall 62 and a floor 64. The pair of sidewalls 57 and 58 associated with each of the channels 54 prevent each of the magnets 30 from moving lengthwise. The pair of sidewalls 57 and 58 is aligned perpendicular to each of the plurality of channels 54 formed in the bottom tray member 29.

Each of the channels 54 further has a spacer wall 67 which extends between the rear wall 62 and the front wall 60 of the adjacent channel 54. The front most and rearward most channels, 54A and 54J respectively, are further spaced from the perimeter wall 65 by a spacer wall 67. In other implementations, the spacer walls 67 are omitted, wherein the front and rear walls, 60 and 62 respectively, intersect and wherein the front and rear walls, 60 and 62 respectively, of the front most and rearward most channels, 54A and 54J respectively, intersect with the perimeter wall 65.

Referring now to FIG. 14, a portion of the bottom tray member 29 is sized and configured to nest in the open interior cavity 36 of the top tray member 28 and forms a plurality of nesting channels 55A, 55B, 55C, 55D, 55E, 55F, 55G, 55H, 55I and 55J. Desirably, the top tray member 28 and the bottom tray members 29 are secured about their perimeters, i.e. the rims 56 and 80, to form a secure attachment. The bottom tray member 29 is bonded to the top tray member 28 after a portion of the bottom tray member 29 engages the open interior cavity 36 of the top tray member 28. The plurality of magnets 30 are held secure between the top tray member 28 and the bottom tray member 29. Each of the magnets 30 is retained within one of the plurality of nesting channels 55A, 55B, 55C, 55D, 55E, 55F, 55G, 55H, 55I and 55J. The plurality of magnets 30 are angled upward due to the inclination of the rear wall 42 of the channels 34.

Referring now to FIGS. 13 and 14, when the channels 54 receive the magnets 30, the rear wall 62 will supports a back face 66 of each of the magnets 30. The floor 64 will support a lower edge 68 of each of the magnets 30. When a portion of the bottom tray member 29 is nested in the open interior cavity 36 of the top tray member 28, see FIG. 13, the rear wall 42 of the top tray member 28 will contact and abuts a front face 70 of the received magnet 30. At the same time, the front wall 40 and the spacer wall 45 of the channel 34, to a rear of the channel 34 and opposite the particular channel 54, will contact and be positioned adjacent to a top edge 72 of the enclosed magnet 30. In FIG. 14, the spacer wall 45 contacts the upper left corner of the enclosed magnet 30 while the front wall 40 contacts and abuts the upper right corner of the enclosed magnet 30. As a result, the magnet 30 is contacted by surfaces of both the bottom tray member 29 and the top tray member 28 in all four dimensions, the bottom, the top, the front and the rear of the magnet 30.

It should be understood that the top edge 72 of each of the magnets 30 could contact the spacer wall 45, if desired. Furthermore, all four sides of each of the magnets 30 does not have to contact a surface of either the top or bottom tray, 28 and 29 respectively, in some embodiments.

Referring again to FIGS. 10 and 11, each of the channels 54 formed in the bottom tray member 29 has a pair of sidewalls 57 and 58. Each of the plurality of magnets 30 has a rectangular configuration. Other shape magnets 30 could be used, if desired. The rectangular shape magnets 30 if preferred because it is relatively easy to cut the magnets 30 to a predetermined length from an elongated bar material. Each of the magnets 30, see FIG. 11, has a length l, a width w and a thickness t. The length l, the width w and the thickness t can all vary. The length l can range from between about 1 inch to about 4 inches. Desirably, the length l can range from between about 1.5 inches to about 3 inches. More desirably, the length l can be about 1.5 inches. The width w can range from between about 0.5 inches to about 2 inches. Desirably, the width w can range from between about 0.75 inches to about 1.5 inches. More desirably, the width w is about 1 inch. The thickness t can range from between about 0.1 inches to about 0.5 inches. Desirably, the thickness t can range from between about 0.2 inches to about 0.4 inches. More desirably, the thickness t can be about 0.25 inches.

A magnet 30 having a length l of at least 2 inches, a width w of at least about 1 inch, and a thickness t of at least about 0.25 inches, works well.

Figure 11:
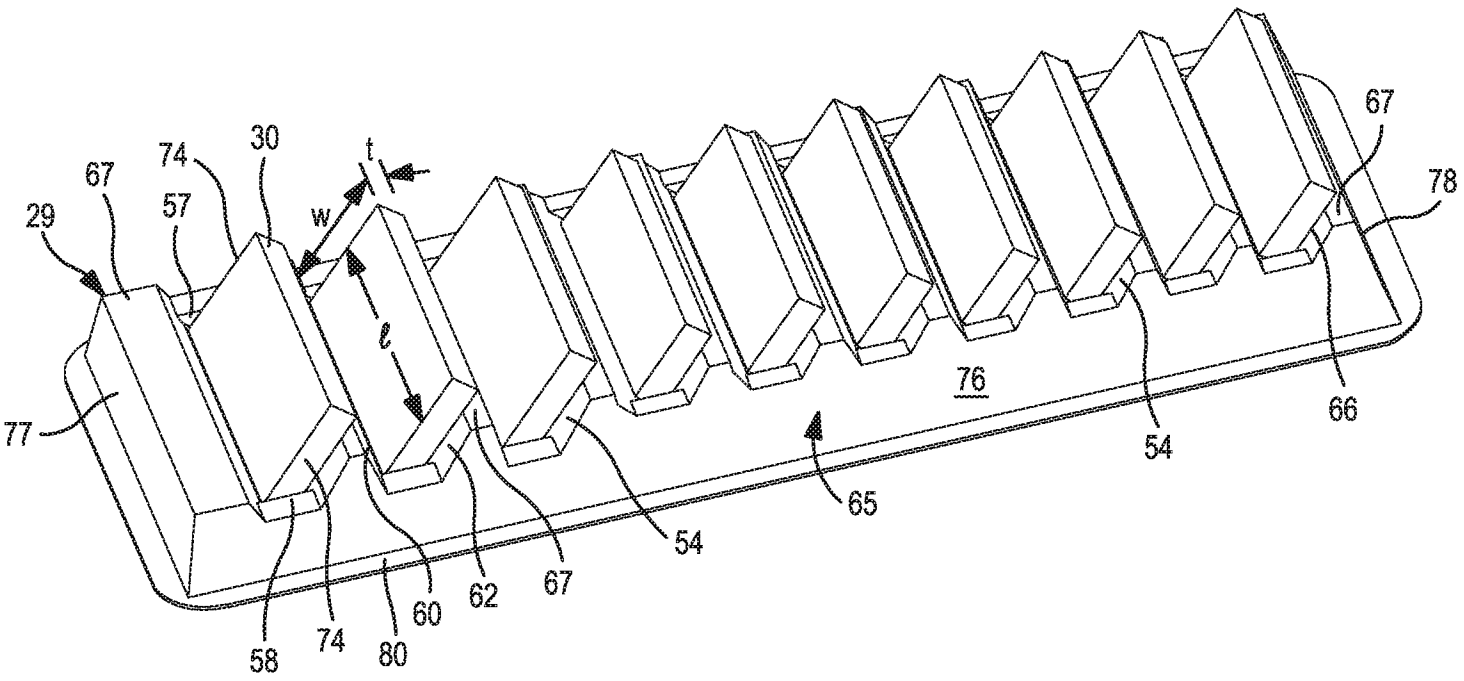
FIG. 11 is a perspective view of the bottom tray member supporting a plurality magnets.

Still referring to FIG. 11, the rectangular configured magnet 30 includes a pair of side edges 74, 74. The side edges 74, 74 function to retain each of the magnets 30 in place in the channel 54 and to hold it stationary. The sidewalls 57 and 58 of each of the channels 54 contact the side edges 74, 74 of each magnet 30 and prevent the magnet 30 from moving. Consequently, each of the magnets 30 is securely retained in place against movement without adhesive applied to the magnets 30. Thus, assembly and fabrication of the magnet sandwiching storage tray 20 is simplified. Recycling of the magnet sandwiching storage tray 20 and/or the magnets 30 is further facilitated. In other implementations, the magnets 30 can be fused, bonded or fastened to the bottom tray member 29 and/or to the top tray member 28 using any means known to those skilled in the art, including but not limited to an adhesive, glue, epoxy, etc.

Still referring to FIG. 11, the channels 54 formed in the bottom tray member 29 can have different depths. The different depths of the channels 54 accommodate the different depths of the magnets 30, such that magnets 30 of different heights, corresponding to the height of the channels 34 formed in the top tray member 28 can be used. As illustrated, two different heights of magnet 30 are shown. The two different heights of magnets 30 are arranged such that the taller magnets 30 correspond to the deeper channels 34 and 54, and the shorter magnets 30 correspond to the shallower channels 34 and 54. The channels 34 and 54 have different depths such that each of the magnets 30 extends opposite to or across a majority of the rear wall 42 of each of the channels 34. The depth of the channels 34 is such that the magnets 30 are supported in the bottom tray member 29 so as to extend opposite to and across substantially all of (at least about 90%) of the rear wall 42 and the sidewall 46 of the top tray member 28, see FIG. 13. Each channel 34 receives the shaft 23 of the article 22. In one implementation, the magnets 30 can be of three or more different heights and the channels 34 and 54 can be of corresponding different depths. In another implementation, the magnets 30 can be of one height and the channels 34 and 54 can be of a similar depth.

Referring again to FIGS. 10, 11 and 13, the perimeter wall 65 extends about a perimeter of the bottom tray member 29. The perimeter wall 65 extends between each of the channels 54, while forming a pair of sidewalls 76, a front wall 77, a rear wall 78 and a rim 80. The perimeter wall 65 and the front channel wall 60, the rear wall 62, the floor 64 and the spacer wall 67 define an upper shape configured to be nested within the top tray member 28 such that the upper shape and the associated magnets 30 form a backbone or spine supporting the top tray member 28. As noted above, the top tray member 28 is formed from a relatively thin layer of material such that the article 22 may be more securely held or retained in place by the magnet forces passing through the relatively thin thickness of the rear wall 42. In one implementation, the layer forming the top tray member 28 is constructed from a thin polymer film. As a result, the layer forming the top tray member 28 results in the top tray member 28 having reduced structural rigidity or strength, making the top tray member 28, by itself, susceptible to bending and/or deformation when being manually manipulated or carried, and especially when carrying or supporting a proportionally large amount of weight from the articles 22.

As shown in FIG. 14 the bottom tray member 29 does not identically match the profile or shape of the open interior cavity 36 of the top tray member 28. Rather, the upper shape of the bottom tray member 29 is specifically configured to provide rigid defying support just at those locations where such support may be necessary given the weight of the magnets 30, the weight of the articles 22, and the existing support provided by the adjacent portions of the top tray member 28. The top tray member 28 and the bottom tray member 29 can abut and contact one another at areas 90, 90 as well as at the rims 56 and 80. The top tray member 28 and the bottom tray member 29 can be sealed to one another at the areas 90, 90 and/or at the rims 56 and 80 to form a stronger attachment. Desirably, the top tray member 28 and the bottom tray member 29 are secured at their rims 56 and 80. Glue, adhesive, epoxy, a heat bond, a pressure bond, a heat and pressure bond, an ultrasonic weld or bond, or any other form of attachment known to those skilled in the art can be utilized.

The upper profile of the bottom tray member 29 does project into the open interior cavity 36 of the top tray member 28 but a space is present between the upper profile of the bottom tray member 29 and internal upper nose cavities 93, located directly below the spacer walls 45 of the top tray member 28. As a result, the quantity of material needed for forming the bottom tray member 29 is reduced. This reduces both the cost and weight of the magnet sandwiching storage tray 20. In other implementations, the bottom tray member 29 may have other configurations occupying a different extent of the open interior cavity 36 and contacting/supporting a greater or lesser amount of surface area of the open interior cavity 36 of the top tray member 28. As illustrated, the bottom tray member 29 is integrally formed as a single unitary or homogenous body. The bottom tray member 29 can be formed from a single molded film of material. Alternatively, the bottom tray member 29 can be formed from a single molded film of a polymer. The polymer can be polypropylene, polyethylene or a combination of two or more different polymers. Alternatively, the bottom tray member 29 can be formed from other materials known to those skilled in the art, and in other fashions.

Still referring to FIG. 14, the top tray member 28 has a spacer wall 45 separating adjacent channels 34 formed therein, and the bottom tray member 29 has a spacer wall 67 separating adjacent channels formed therein, and when the bottom tray member 29 engages the open interior cavity 36 of the top tray member 28, the spacer wall 67 of the bottom tray member 29 is spaced apart from the inner surface of the spacer wall 45 of the top tray member 28.

Referring again to FIG. 5, the magnets 30 are permanent magnets captured between the bottom tray member 29 and the top tray member 28. Each of the magnets 30 includes a magnet bar having a rectangular shape, reducing the cost of each of the magnets 30. In other implementations, each of the magnets 30 may have other shapes and other sizes. The magnets 30 exhibit sufficient magnet force through the rear wall 42 to securely retain the articles 22 in place against a front surface of the rear wall 42. Such a magnet force permits the article 22 to be manually withdrawn from the channels 34 with a minor amount of force while preventing accidental dislodging of the articles 22 from the channels 34.

Although the top tray member 28 and the bottom tray member 29 are each illustrated as having parallel channels 34 and 54, respectively, in other implementations, the top tray member 28 and the bottom tray member 29 can extend at an oblique angle to one another. For example, the top tray member 28 and the bottom tray member 29 could each have corresponding channels 34 and 54 that fan out from a point. In one implementation, each of the channels 34 and 54 extend along centerlines that extend radial outward from a forward point or region. Although the top tray member 28 and the bottom tray member 29 are each illustrated as having channels 34 and 54 wherein each has a similar transverse length, from side to side, in other implementations, the channels 34 and 54 could have different transverse lengths, from side to side. For example, the transverse lengths of the channels 34 and 54 could widen from the front of the top and the bottom tray members, 28 and 29 respectively, to the rear of the top and the bottom tray members, 28 and 29 respectively. In another implementation, the widening occurs in a sloped, ramped or gradual fashion. In still another implementation, the widening occurs in a stepwise fashion. In another implementation, the transverse lengths of the channels 34 and 54 could widen from the rear of the top and the bottom tray members. 28 and 29 respectively, to the front of the top and the bottom tray members, 28 and 29 respectively.

Figure 15:
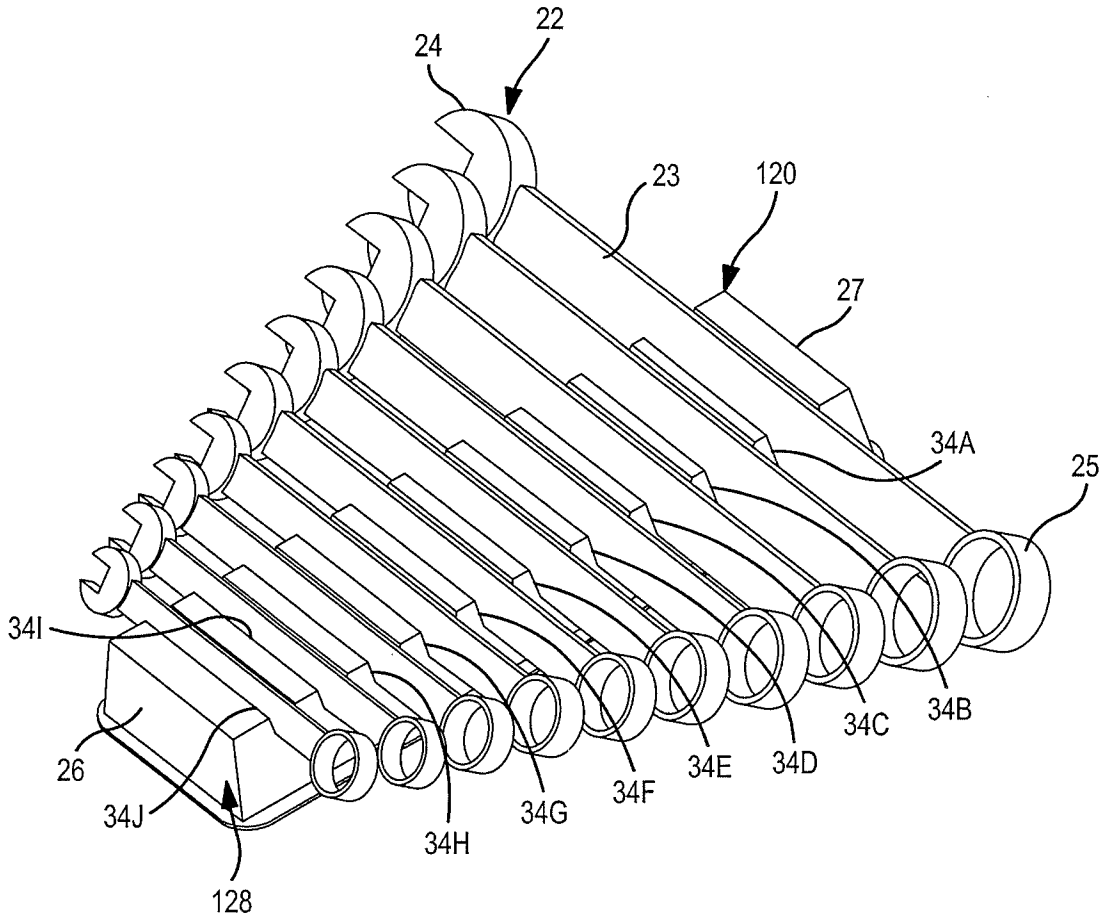
FIG. 15 is a perspective view of another embodiment of a magnet sandwiching storage tray temporarily retaining a plurality of articles, in the form of wrenches.

Referring now to FIGS. 15-22, an alternative embodiment of a magnet sandwiching storage tray 120 is shown. FIG. 15 depicts the articles 22 as wrenches. The magnet sandwiching storage tray 120 is similar to the magnet sandwiching storage tray 20, depicted in FIG. 1-14, except that the magnet sandwiching storage tray 120 retains the articles 22 in an opposite order. The larger articles 22, those having wider shafts 23, are located adjacent to the rear 27 of the magnet sandwiching storage tray 120 while the smaller articles 22, those having less wide shafts 23, are located adjacent to the front 26 of the magnet sandwiching storage tray 120.

Referring to FIG. 15, the top tray member 128 of the magnet sandwiching storage tray 120 is similar to the top tray member 28 of the magnet sandwiching storage tray 20 except that the order of the channels 34 is reversed. In the magnet sandwiching storage tray 120, the channel 34A is located at the rear 27 of the top tray member 28 and the channel 34J the located at the front 26 of the top tray member 28. It should be understood that the components of the top tray member 128, which correspond to the components of the top tray member 28, are numbered similarly.

Figure 16:
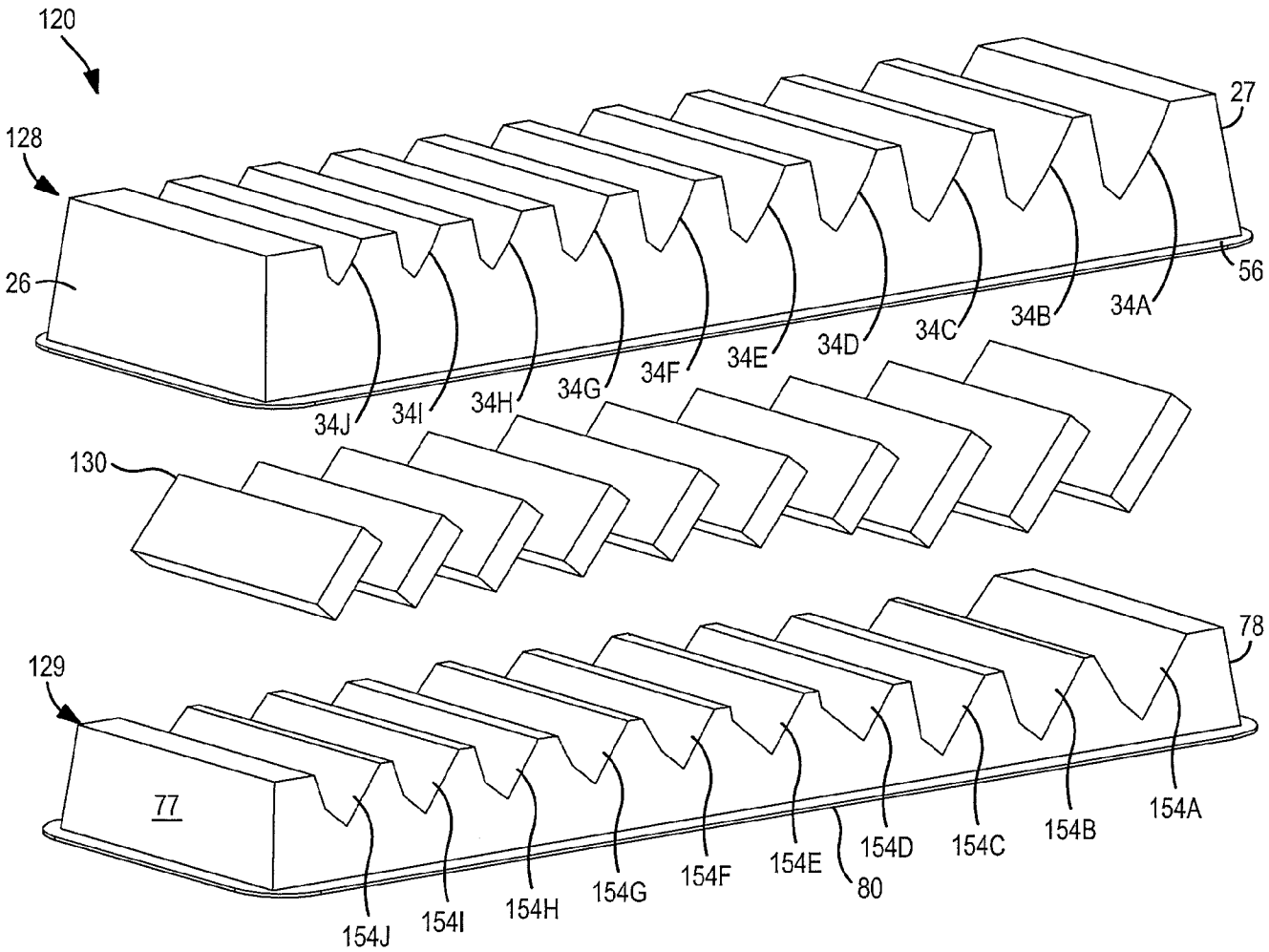
FIG. 16 is an exploded view of the magnet sandwiching storage tray shown in FIG. 15.
Figure 17:
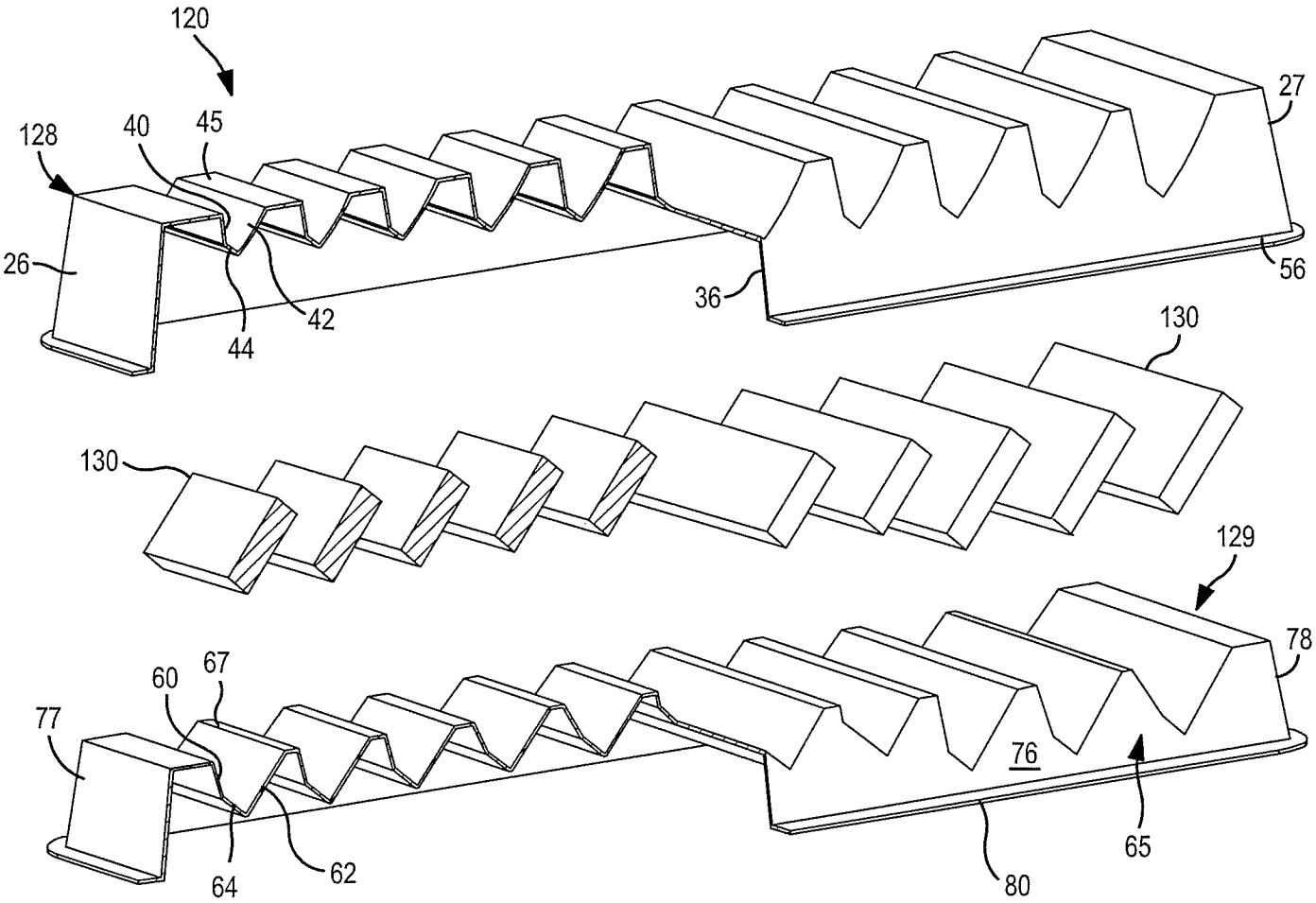
FIG. 17 is a partial cut-a-way view of the magnet sandwiching storage tray shown in FIG. 16.
Figure 18:
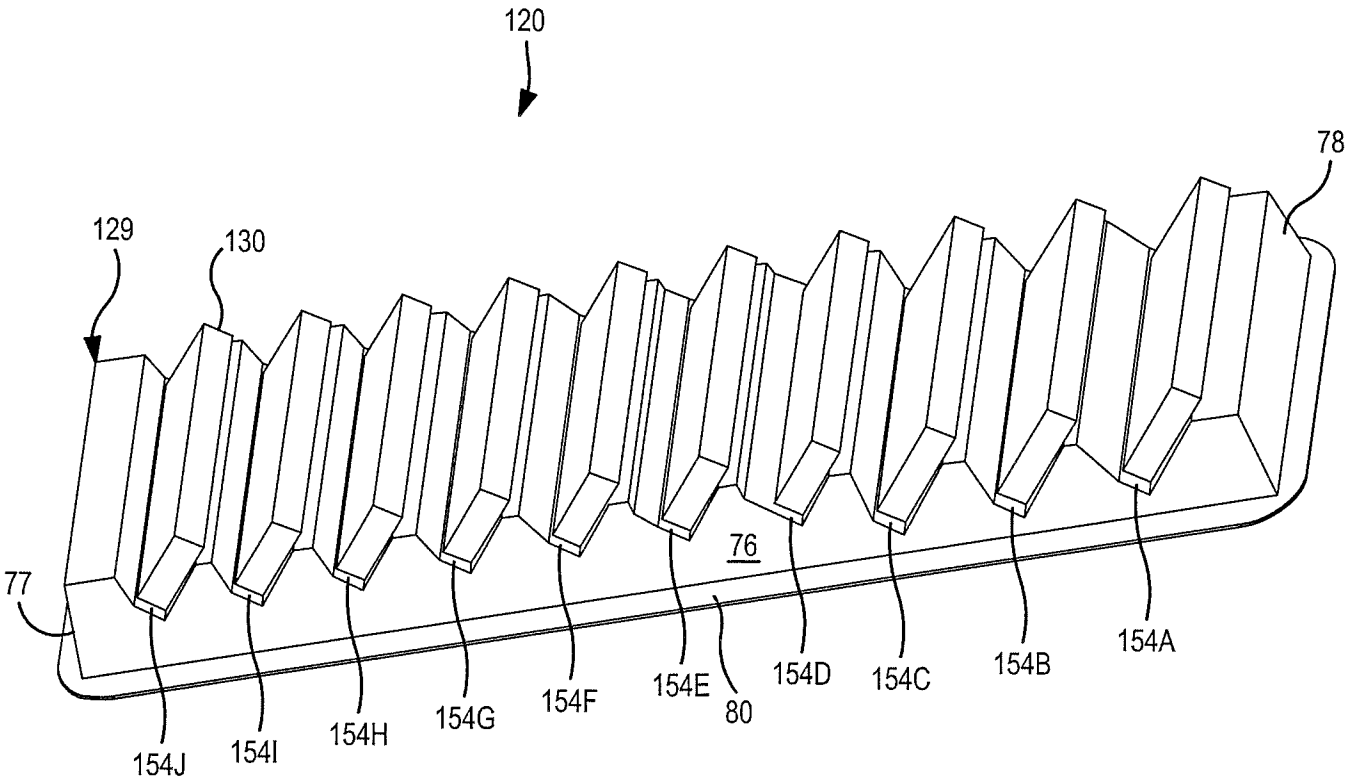
FIG. 18 is a perspective view of the bottom tray member supporting a plurality of magnets.
Figure 20:
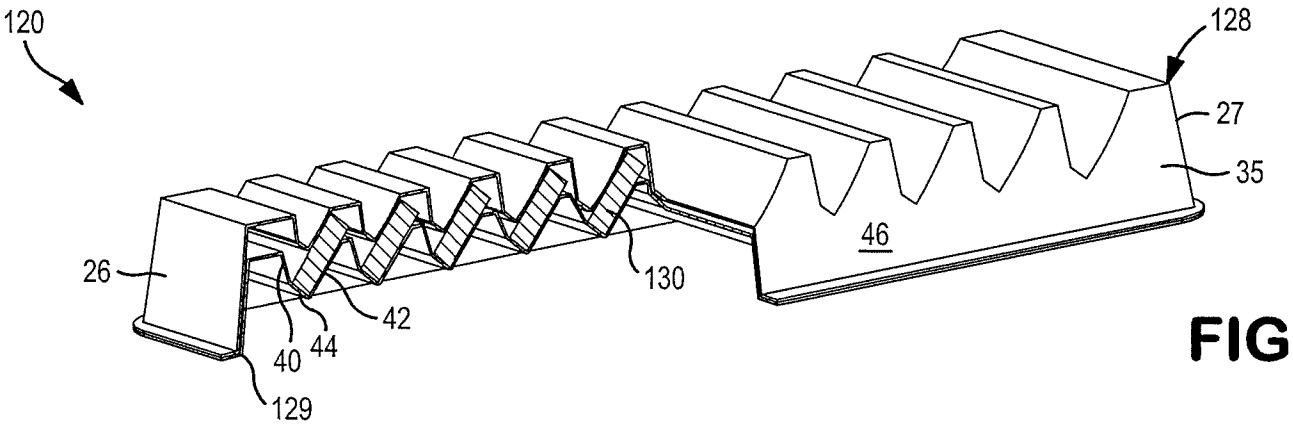
FIG. 20 is a sectional view of the magnet sandwiching storage tray taken along line 20-20 of FIG. 19.
Figure 19:
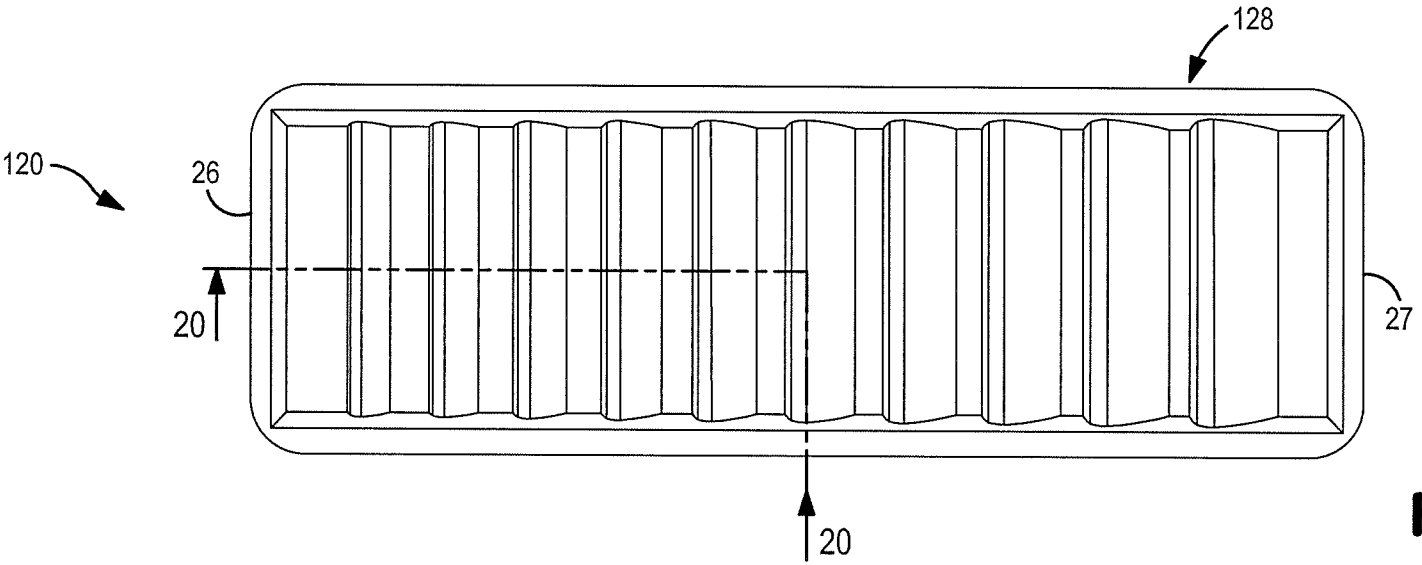
FIG. 19 is a top view of the magnet sandwiching storage tray shown in FIG. 15.
Figure 22:
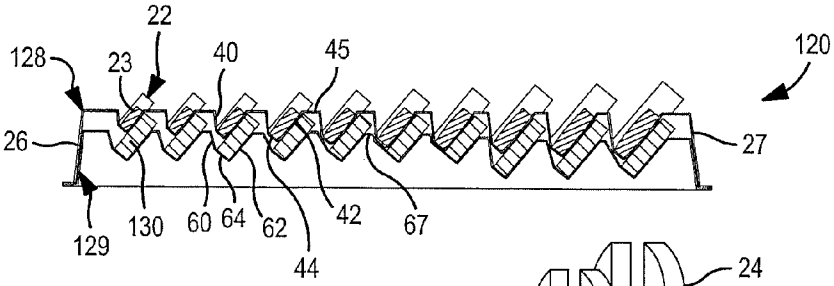
FIG. 22 is a cross-sectional view of the magnet sandwiching storage tray taken along line 22-22 of FIG. 21.
Figure 21:
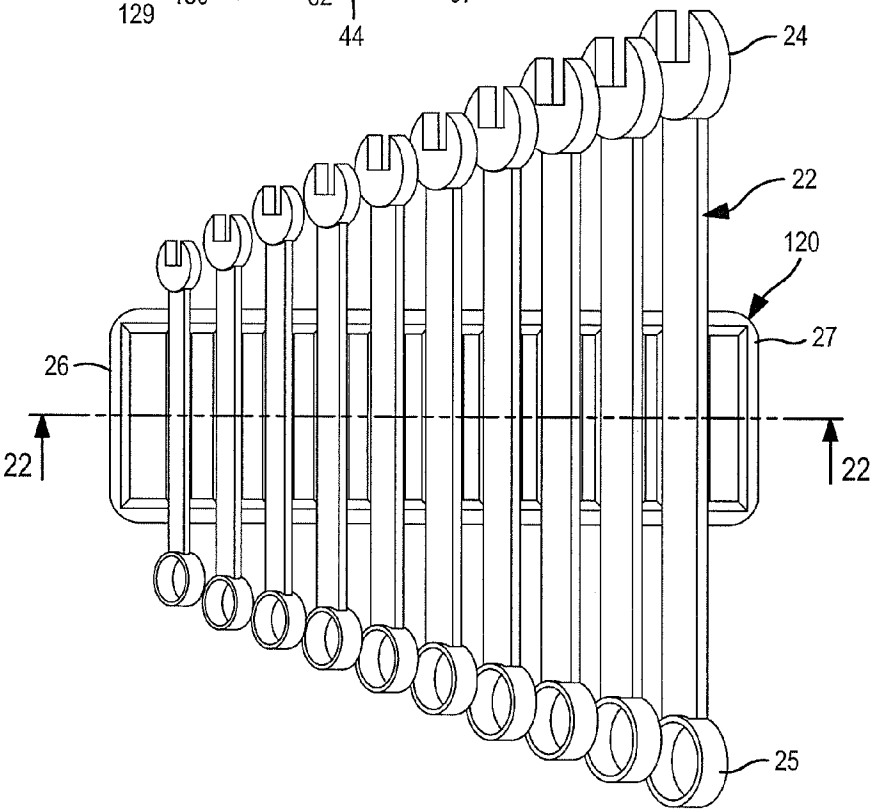
FIG. 21 is a top view of a magnet sandwiching storage tray temporarily retaining a plurality of articles, in the form of wrenches.
Figure 23:
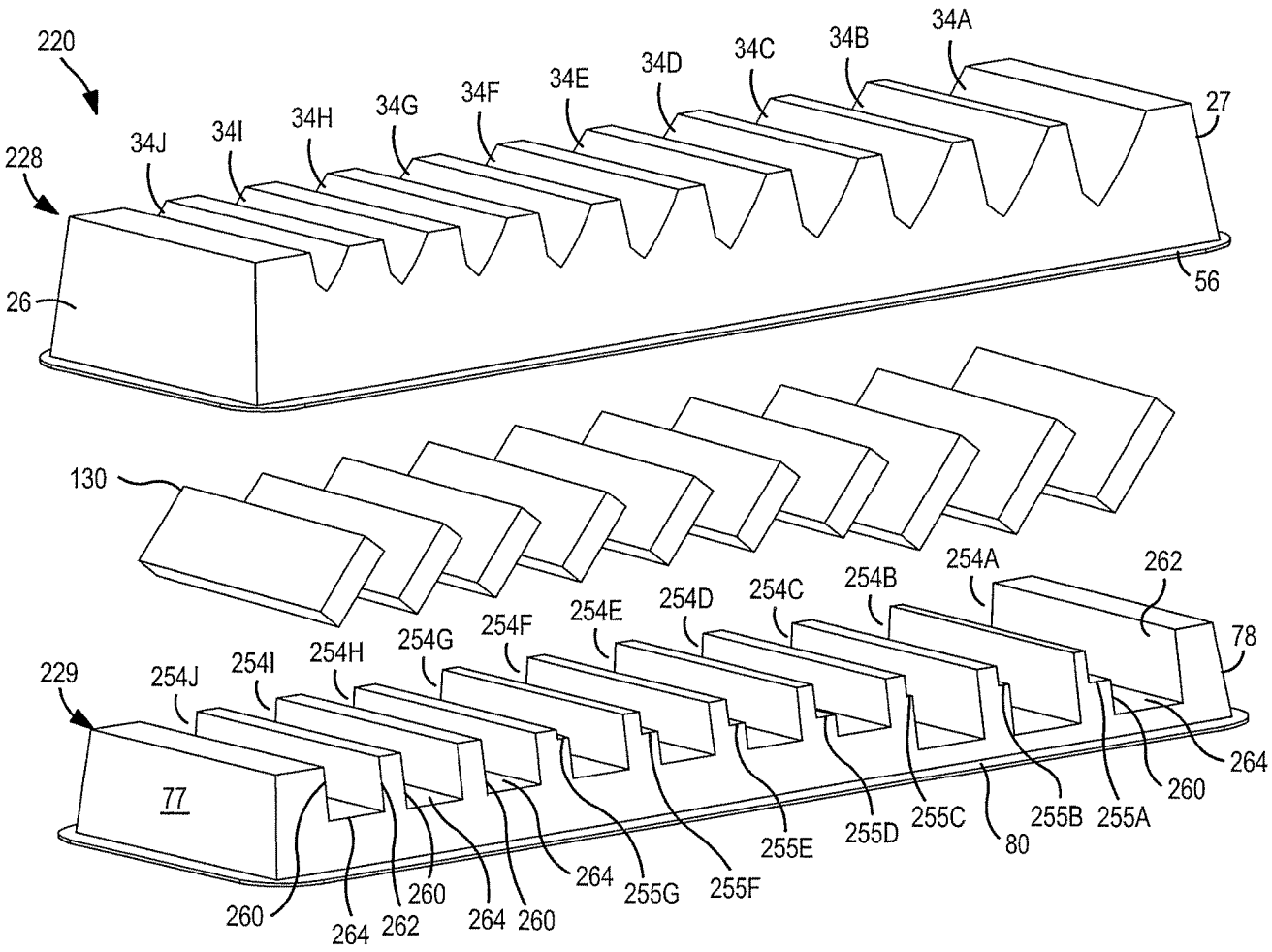
FIG. 23 is an exploded view of third embodiment of a magnet sandwiching storage tray.
Figure 24:
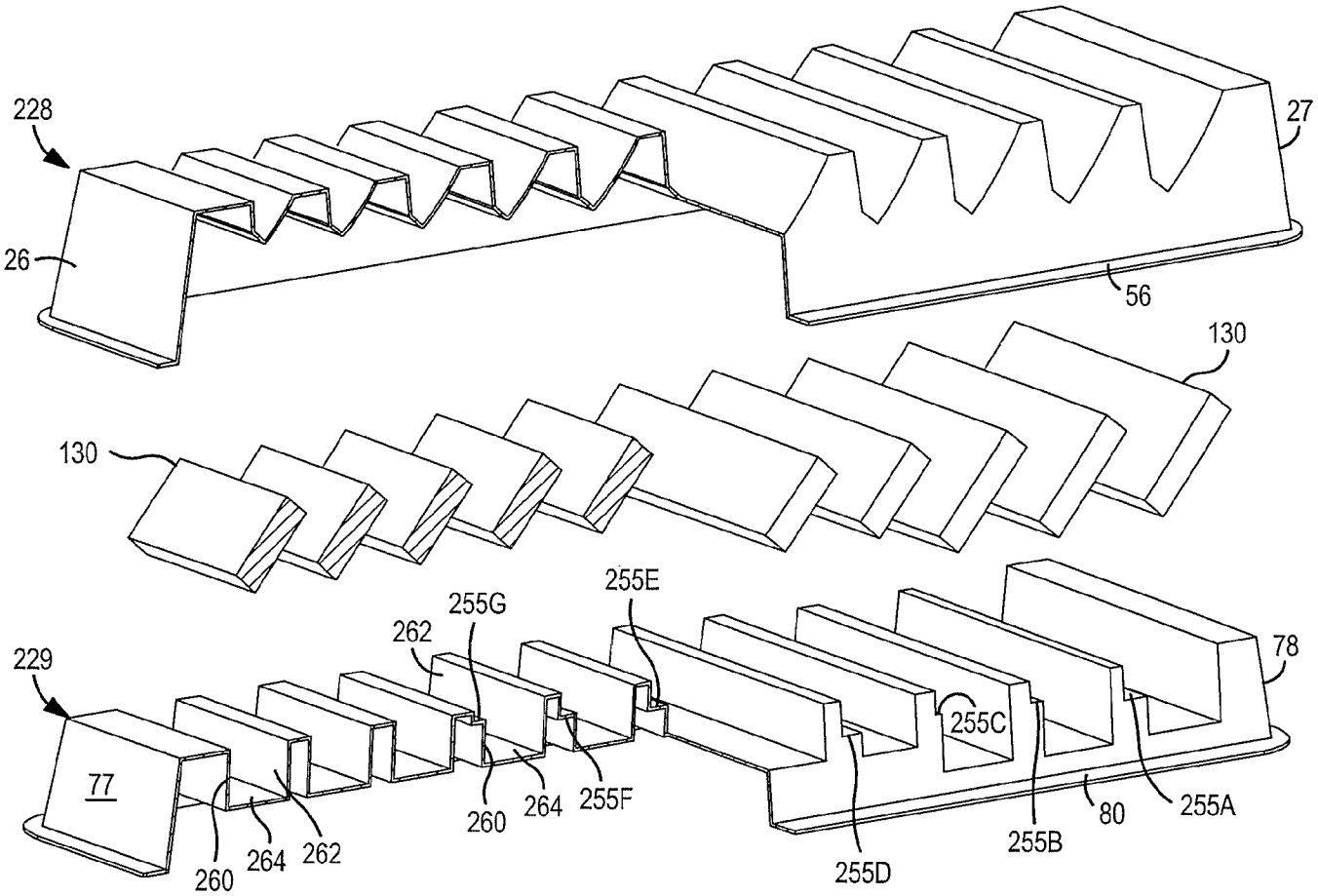
FIG. 24 is a sectional view of the magnet sandwiching storage tray shown in FIG. 23.
Figure 25:
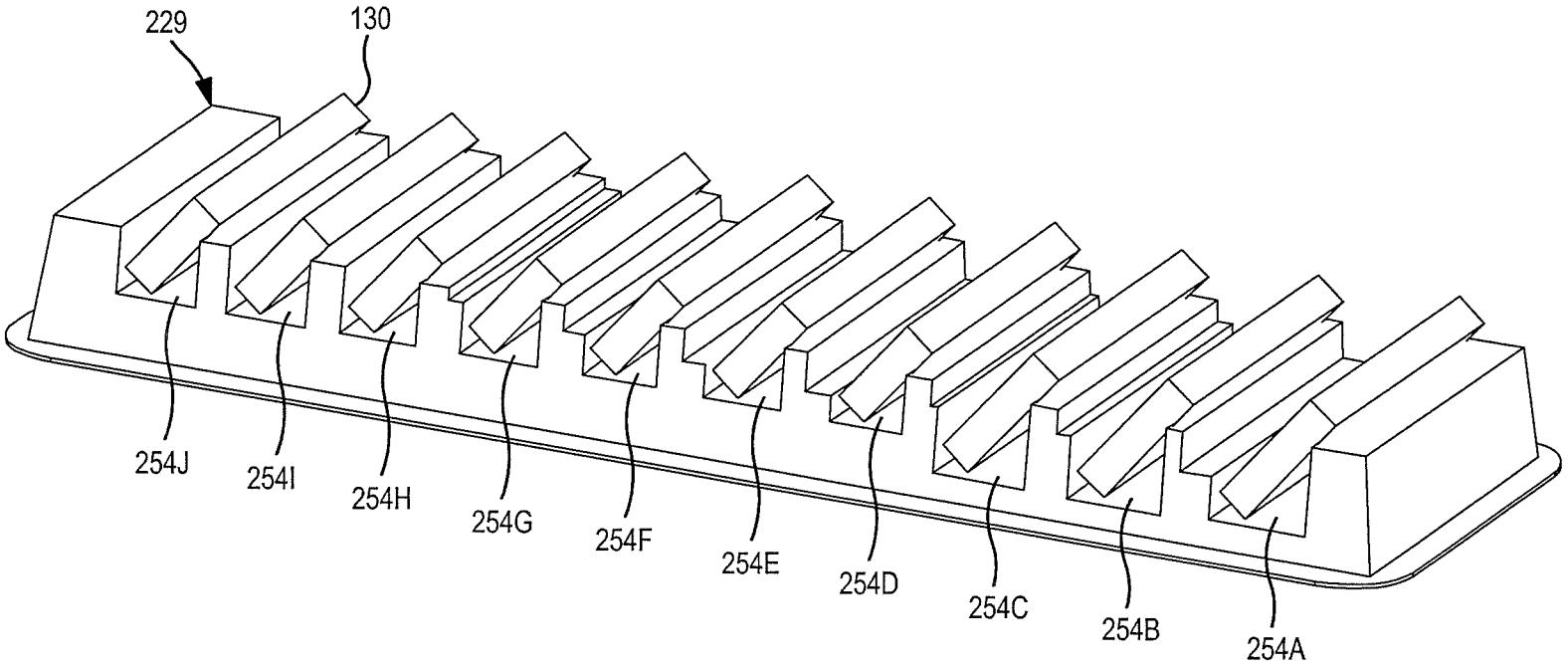
FIG. 25 is a perspective view of the bottom tray member supporting a plurality of magnets.
Figure 27:
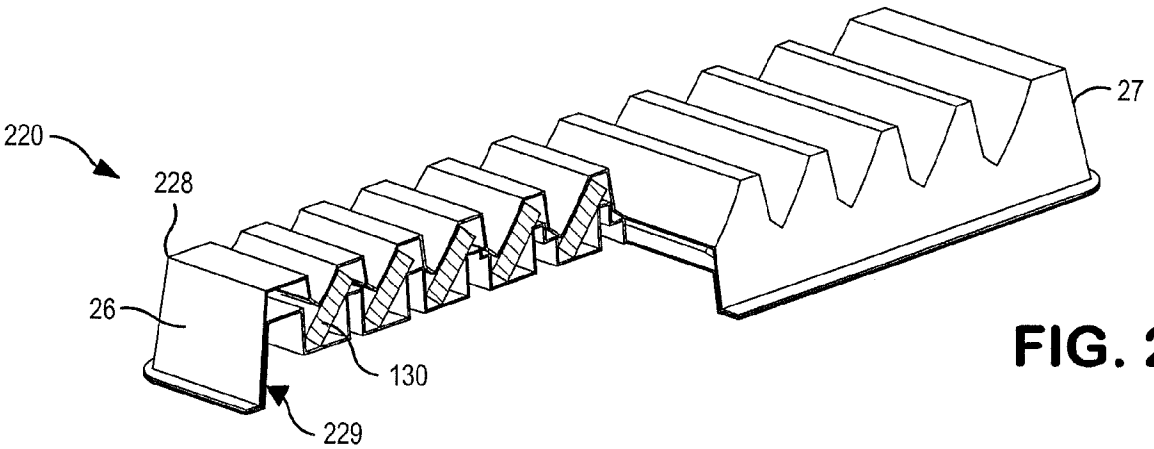
FIG. 27 is a sectional view of the magnet sandwiching storage tray taken along line 27-27 of FIG. 26.
Figure 26:
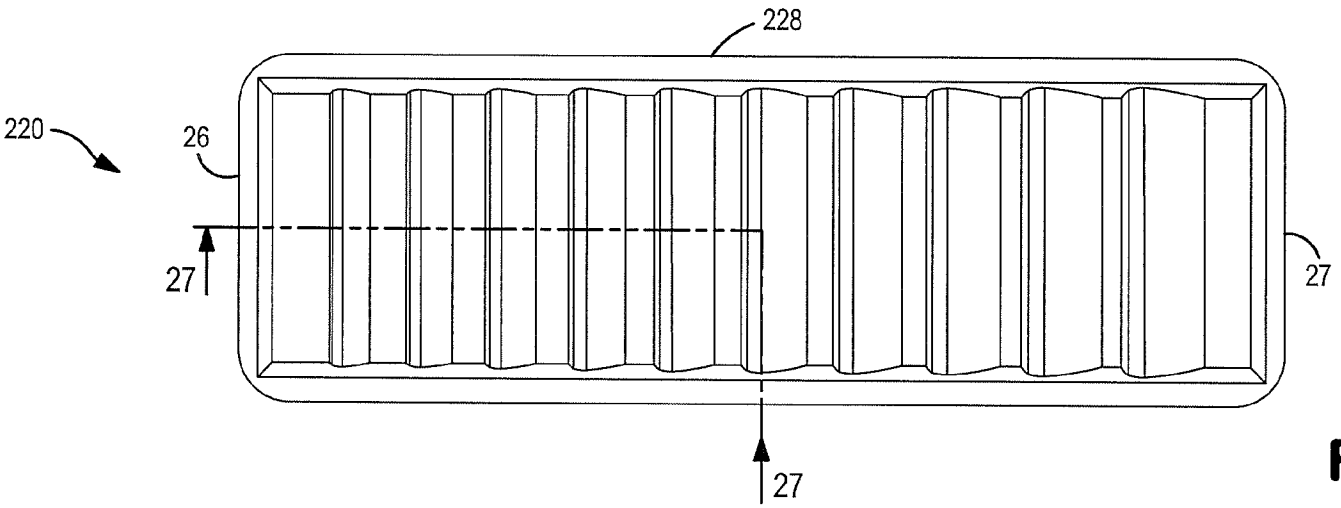
FIG. 26 is a top view of the magnet sandwiching storage tray shown in FIG. 23.
Figure 29:
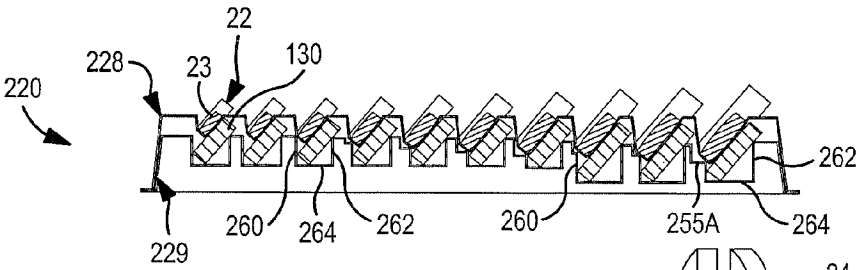
FIG. 29 is a cross-sectional view of the magnet sandwiching storage tray taken along line 29-29 of FIG. 28.

Referring to FIGS. 16-18, the bottom tray member 129 of the magnet sandwiching storage tray 120 is similar to the bottom tray member 29 of the magnet sandwiching storage tray 20 except that the bottom tray member 129 omits the channel sidewalls 57 and, 58, see FIG. 5. Instead, the channels 54 are open at the sides, similar to the first and second open ends, 37 and 38 respectively, of the channels 34. As shown in FIG. 18, the magnets 130 are similar to the magnets 30, see FIG. 5, except that the magnets 130 are longer. This means that the magnets 130 can contact the inside surface of the sidewalls 46, 46, see FIG. 20, to restrict transverse movement of the magnets 130. In other implementations, the magnets 130 may have shorter length, similar to the magnets 30, wherein transverse movement of the magnets 130 is permitted or where the magnets 130 are secured in place by adhesive, glue, welding, by fasteners or by some other structure known to those skilled in the art. In other implementations, the magnets 130 may have shorter length, similar to the magnets 30, and the top tray member 128 and the bottom tray member 129 are narrower so that the inside surfaces of the sidewalls 46, 46 restrict transverse movement of the magnets 130.

Referring now to FIGS. 23-29, a third embodiment of a magnet sandwiching storage tray 220 is shown. The magnet sandwiching storage tray 220 is similar to the magnet sandwiching storage tray 120 except that the bottom tray member 229 has differently configured channels 254. The channels 254 have a square or rectangular profile.

The bottom tray member 229 of the magnet sandwiching storage tray 220 is similar to the bottom tray member 129 of the magnet sandwiching storage tray 120 except that the bottom tray member 229 includes channels 254A, 254B, 254C, 254D, 254E, 254F, 254G, 254H, 254I and 254J (collectively referred to as channels 254) in place of the channels 154A, 154B, 154C, 154D, 154E, 154F, 154G, 154H, 154I and 154J, respectively. The remaining components of the bottom tray member 229, which correspond to the bottom tray member 129, are numbered similarly. The channels 254 of the magnet sandwiching storage tray 220 are similar to the channels 154 of the magnet sandwiching storage tray 220 except that each of the channels 254 has a front wall 260, a rear wall 262 and a floor 264. In contrast to the front wall 60, the rear wall 62, and the floor 64 of channels 154, which are each angled or oblique relative to a horizontal or the bottom of magnet sandwiching storage tray 120, the front wall 260 and the rear wall to 62 of the magnet sandwiching storage tray 220 extend in planes that are perpendicular to the horizontal, and the floor 264 extends in a horizontal plane. Another way of stating this is to say that the floor 264 is perpendicularly aligned to the front and rear walls, 260 and 262 respectively. To accommodate the deeper corresponding channels 34A-34G of the top tray member 228, see FIG. 23, the front wall 260 of each of the channels 254A-254G includes a step 255A-255G (collectively referred to as steps 255). Each of the steps 255 include a notch which extends along each of the front walls 260. Each of the steps 255 extend along a plane that is aligned parallel and perpendicular to the horizontal. Each of the steps 255 accommodate the oblique angle of the front walls 40 of each of the channels 34 formed in the top tray member 228, see FIG. 23. Because the front wall 260, the rear wall 262, the floor 264, and each of the steps 255 extend in planes that are parallel or perpendicular to the horizontal, tooling and manufacturing of the bottom tray member 229 may be less complex and less expensive. At the same time, the front wall 260, the rear wall 262, the floor 264, and each of the steps 255 continue to support the magnets 130 at oblique angles against the rear wall 42 of the channels 34 to enhance magnet retention of the articles 22 within each of the channels 34. In addition, the front wall 260, the rear wall 262, the floor 264, and each of the steps 255 continue to serve as support for the top tray member 228, allowing the top tray member 228 to be thinner, thereby allowing the magnets 130 to be closer to the articles 22. This allows for increased magnet retention of the articles 22 on the magnet sandwiching storage tray 220.

Figure 28:
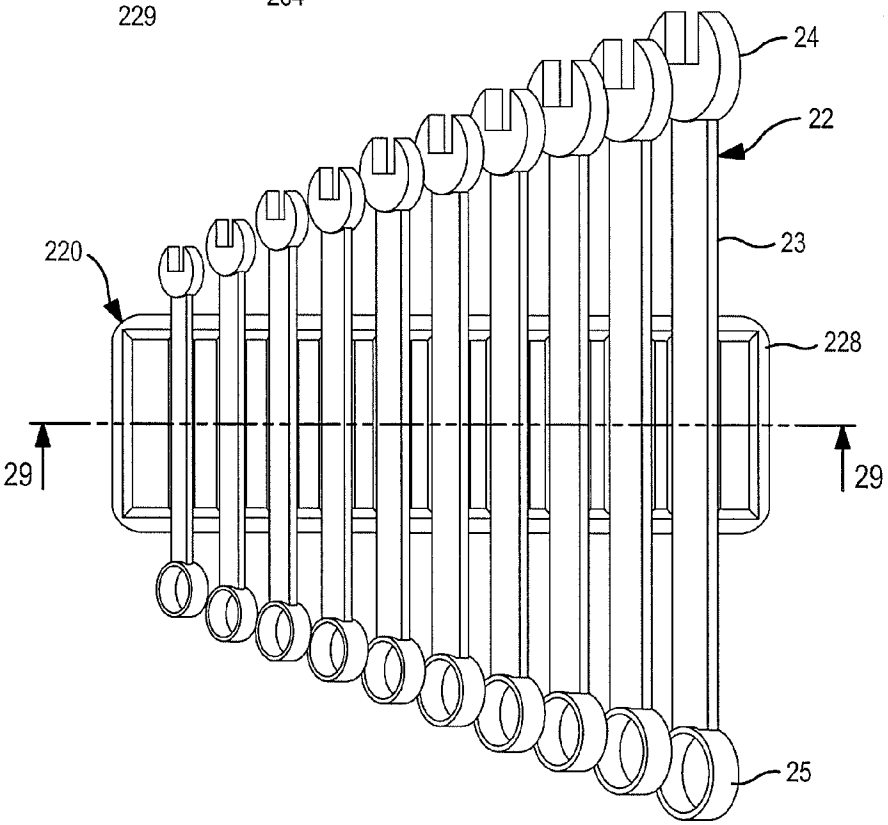
FIG. 28 is a top view of a magnet sandwiching storage tray temporarily retaining a plurality of articles, in the form of wrenches.

Referring to FIG. 28, the magnet sandwiching storage tray 220 includes a plurality of articles 22. Ten articles 22 are depicted. The magnet sandwiching storage tray 220 should be capable of retaining at least three articles 22, in the form of wrenches. Each wrench has a similar configuration and each is of a different size. Each of the wrenches has a shaft 23 with a head 24 formed on a first end and a head 25 formed on an oppositely aligned second end. Each of the shafts 23 has a length that is greater than each of the plurality of channels 34 formed in the top tray member 28, whereby the heads 24 and 25 of each of the wrenches project beyond the channels 34 formed in the top tray member 28 in which it is retained.

While the invention has been described in conjunction with several specific embodiments, it is to be understood that many alternatives, modifications and variations will be apparent to those skilled in the art in light of the foregoing description. Accordingly, this invention is intended to embrace all such alternatives, modifications and variations which fall within the spirit and scope of the appended claims. Furthermore, some well-known structures or functions may not be shown or described in detail because such structures or functions would be known to one skilled in the art.

We claim:

1. A magnet sandwiching storage tray for retaining a plurality of articles, each of said plurality of articles having a portion with magnet affinity, comprising:

a) a top tray member having a 3-dimensional configuration with a perimeter and having a plurality of channels aligned parallel to one another, each of said plurality of channels sized and shaped to receive an article, each of said plurality of channels having an open first end, an oppositely aligned open second end, a front wall, a rear wall and a floor, said rear wall being angled upward and terminating at a spacer wall, each of said spacer walls separating adjacent channels, and said top tray member having a bottom with an open interior cavity formed therein;

b) a bottom tray member having a 3-dimensional configuration with a perimeter and having a plurality of channels aligned parallel to one another, each of said plurality of channels sized and shaped to receive a magnet, each of said plurality of channels formed in said bottom tray member corresponding with one of said plurality of channels formed in said top tray member, a portion of said bottom tray member being sized and configured to nest in said open interior cavity of said top tray member and forming a plurality of nesting channels, and said bottom and top tray members being secured about their perimeters; and c) a plurality of magnets each being retained within one of said plurality of nesting channels, each of said magnets having a front face underlying said rear wall of each of said channels formed in said top tray member so as to magnetically attract and retain one of said articles against said rear wall of each of said plurality of channels formed in said top tray member.

2. The magnet sandwiching storage tray of claim 1 wherein each of said plurality of magnets rests within one of said pair of plurality of nesting channels, each of said plurality of magnets is angled upwards, and the depth of said plurality of channels formed in said bottom tray vary.

3. The magnet sandwiching storage tray of claim 2 wherein each of said plurality of channels formed in said bottom tray member has a pair of sidewalls, and said pair of sidewalls of each channel prevent said magnet from moving lengthwise, and said top and bottom tray members are secured together.

4. The magnet sandwiching storage tray of claim 3 wherein each of said plurality of magnets has a rectangular configuration with a front face, a pair of side edges, a lower edge and a top edge, and said front face contacts said rear wall of said top tray member, said pair of side edges contact said pair of sidewall of said bottom tray member, and said lower edge contacts said floor of said bottom tray member.

5. The magnet sandwiching storage tray of claim 3 wherein said pair of sidewalls formed in said bottom tray member is aligned perpendicular to each of said plurality of channels formed in said bottom tray member.

6. The magnet sandwiching storage tray of claim 1 wherein said rear walls of each of said plurality of channels formed in said top tray member are aligned parallel to one another and each is angled from between about 10° to about 80° relative to a vertical axis, and said plurality of magnets are of at least two different heights.

7. The magnet sandwiching storage tray of claim 6 wherein said front wall of each of said plurality of channels formed in said top tray member are aligned parallel to one another and each is aligned parallel to said spacer walls.

8. The magnet sandwiching storage tray of claim 1 wherein said bottom tray member is bonded to said top tray member about their perimeters after said bottom tray member engages said open interior cavity of said top tray member.

9. The magnet sandwiching storage tray of claim 1 wherein said top tray member is formed from a polymer having a thickness of from between about 0.006 inches to about 0.05 inches.

10. A magnet sandwiching storage tray for retaining a plurality of articles, each of said plurality of articles having a portion with magnet affinity, comprising:

a) a top tray member having a 3-dimensional configuration with a perimeter and having a plurality of channels aligned parallel to one another, each of said plurality of channels sized and shaped to receive an article, each of said plurality of channels having an open first end, an oppositely aligned open second end, a front wall, a rear wall and a floor, said rear wall being angled upward at from between about 10° to about 80° relative to a vertical axis and terminating at a spacer wall, each of said spacer walls separating adjacent channels, and said top tray member having a bottom with an open interior cavity formed therein;

b) a bottom tray member having a 3-dimensional configuration with a perimeter and having a plurality of channels aligned parallel to one another, each of said plurality of channels sized and shaped to receive a magnet, each of said plurality of channels formed in said bottom tray member corresponding with one of said plurality of channels formed in said top tray member, a portion of said bottom tray member being sized and configured to nest in said open interior cavity of said top tray member and forming a plurality of nesting channels, and said bottom and top tray members being secured about their perimeters; and c) a plurality of magnets each being retained within one of said plurality of nesting channels, each of said magnets having a rectangular configuration with a front face underlying said rear wall of each of said channels formed in said top tray member so as to magnetically attract and retain one of said articles against said rear wall of each of said plurality of channels formed in said top tray member.

11. The magnet sandwiching storage tray of claim 10 wherein each of said plurality of rectangular configured magnets has a length of at least about 1.5 inches, a width of at least about 1 inch, and a thickness of at least about 0.25 inches.

12. The magnet sandwiching storage tray of claim 10 wherein each of said plurality of channels formed in said top tray member has a depth, and the depth of at least one of said channels is greater than the depth of one of said remaining channels, and said plurality of magnets are of at least two different heights.

13. The magnet sandwiching storage tray of claim 10 wherein each of said plurality of channels formed in said top tray member has a depth, and the depth of all of said channels is the same.

14. The magnet sandwiching storage tray of claim 10 wherein said top tray member is integrally formed as a single unitary body, said bottom tray member is integrally formed as a single unitary body, and a portion of said bottom tray member is sized and configured to nest within said open interior cavity of said top tray member and enclose and hold stationary each of said plurality of magnets.

15. The magnet sandwiching storage tray of claim 10 wherein said rear wall of each of said plurality of channels formed in said top tray member extend upward at an angle of from between about 30° to about 60° relative to a vertical axis.

16. A magnet sandwiching storage tray for retaining a plurality of articles, each of said plurality of articles having a portion with magnet affinity, comprising:

a) a top tray member having a 3-dimensional configuration with a perimeter and having a plurality of channels aligned parallel to one another, each of said plurality of channels sized and shaped to receive an article, each of said plurality of channels having an open first end, an oppositely aligned open second end, a front wall, a rear wall and a floor, said rear wall being angled upward at from between about 30° to about 60° relative to a vertical axis and terminating at a spacer wall, each of said spacer walls separating adjacent channels, and said top tray member having a bottom with an open interior cavity formed therein;

b) a bottom tray member having a 3-dimensional configuration with a perimeter and having a plurality of channels aligned parallel to one another, each of said plurality of channels sized and shaped to receive a magnet, each of said plurality of channels formed in said bottom tray member corresponding with one of said plurality of channels formed in said top tray member, a portion of said bottom tray member being sized and configured to nest in said open interior cavity of said top tray member and forming a plurality of nesting channels, and said bottom and top tray members being secured about their perimeters; and c) a plurality of magnets each being retained within one of said plurality of nesting channels, each of said magnets having a front face underlying said rear wall of each of said channels formed in said top tray member so as to magnetically attract and retain one of said articles against said rear wall of each of said plurality of channels formed in said top tray member.

17. The magnet sandwiching storage tray of claim 16 wherein each of said plurality of magnets is held stationary between said top tray member and said bottom tray member, each of said plurality of magnets are aligned parallel to one another and at an angle to a vertical axis, and said top and bottom tray members are secured together by a heat bond.

18. The magnet sandwiching storage tray of claim 16 wherein said top tray member has a spacer wall separating adjacent channels formed therein and said bottom tray member has a spacer wall separating adjacent channels formed therein, and when said bottom tray member engages said open interior cavity of said top tray member, said spacer wall of said bottom tray member is spaced apart from an inner surface of said spacer wall of said top tray member.

19. The magnet sandwiching storage tray of claim 16 wherein said plurality of articles include at least three wrenches, each having a similar configuration and each being of a different size, each wrench having a shaft with a head formed on a first end and a head formed on an oppositely aligned second end, and each of said shafts has a length that is greater than each of said plurality of channels formed in said top tray member, whereby said heads of each of said wrenches project beyond said channels formed in said top tray member in which it is retained.

20. The magnet sandwiching storage tray of claim 16 wherein said top tray member and said bottom tray member are each formed from a polymer film having the same thickness, said thickness is less than about 0.05 inches, and said top and bottom tray members are secured together by an adhesive.

* * * * *